US012788195B2

(12) United States Patent
Hyun et al.

(10) Patent No.: US 12,788,195 B2
(45) Date of Patent: Nov. 10, 2026

(54) CLEANER, CLEANER SYSTEM, AND CONTROL METHOD OF CLEANER SYSTEM

(71) Applicant: LG Electronics Inc., Seoul (KR)

(72) Inventors: Kietak Hyun, Seoul (KR); Heegu Park, Seoul (KR); Jaeheon Chung, Seoul (KR); Daewoo Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 170 days.

(21) Appl. No.: 18/692,670

(22) PCT Filed: Aug. 4, 2022

(86) PCT No.: PCT/KR2022/011510

§ 371 (c)(1),
(2) Date: Mar. 15, 2024

(87) PCT Pub. No.: WO2023/043056

PCT Pub. Date: Mar. 23, 2023

(65) Prior Publication Data

US 2024/0374100 A1 Nov. 14, 2024

(30) Foreign Application Priority Data

Sep. 16, 2021 (KR) ..... 10-2021-0123826

(51) Int. Cl.

| | |
|---|---|
| ***A47L 9/28*** | (2006.01) |
| ***A47L 9/00*** | (2006.01) |
| ***A47L 9/14*** | (2006.01) |

(52) U.S. Cl.

CPC ..... *A47L 9/2894* (2013.01); *A47L 9/0063* (2013.01); *A47L 9/1454* (2013.01); *A47L 9/149* (2013.01); *A47L 9/2842* (2013.01); *A47L 9/2873* (2013.01); *A47L 2201/022* (2013.01); *A47L 2201/024* (2013.01); *A47L 2201/06* (2013.01)

(58) Field of Classification Search

None

See application file for complete search history.

(56) References Cited

U.S. PATENT DOCUMENTS

| | | | | |
|---|---|---|---|---|
| 2017/0042400 | A1* | 2/2017 | Lee | A47L 5/36 |
| 2020/0029765 | A1 | 1/2020 | Morin et al. | |
| 2020/0154967 | A1* | 5/2020 | Sato | A47L 9/327 |

FOREIGN PATENT DOCUMENTS

| | | |
|---|---|---|
| EP | 4403084 A1 | 7/2024 |
| KR | 10-1202916 | 11/2012 |

(Continued)

OTHER PUBLICATIONS

Extended European Search Report in European Appln. No. 22870143.9, mailed on Jan. 8, 2026, 10 pages.

*Primary Examiner* — Kaj K Olsen
*Assistant Examiner* — Pradhuman Parihar
(74) *Attorney, Agent, or Firm* — Fish & Richardson P.C.

(57) ABSTRACT

The present disclosure relates to a cleaner station and a cleaner system, and a method for controlling the cleaner system. According to an embodiment, by driving the suction motor of the cleaner after the drive of the dust collecting motor of the cleaner station is finished, it is possible to suck back, into the dust bin, foreign substances such as strands of hair etc. which stuck and remain in an open end of the dust bin even after collecting the dust in the dust bin so that the foreign substances can be removed.

9 Claims, 18 Drawing Sheets

(56) References Cited

FOREIGN PATENT DOCUMENTS

| | | | |
|---|---|---|---|
| KR | 10-1680884 | | 12/2016 |
| KR | 10-2019-0138893 | | 12/2019 |
| KR | 10-2208334 | B1 | 1/2021 |
| KR | 10-2021-0019940 | | 2/2021 |

* cited by examiner

CLEANER, CLEANER SYSTEM, AND CONTROL METHOD OF CLEANER SYSTEM

CROSS-REFERENCE TO RELATED APPLICATIONS

This application is a National Stage application under 35 U.S.C. § 371 of International Application No. PCT/KR2022/011510, filed on Aug. 4, 2022, which claims the benefit of Korean Application No. 10-2021-0123826, filed on Sep. 16, 2021. The disclosures of the prior applications are incorporated by reference in their entirety.

TECHNICAL FIELD

The present disclosure relates to a cleaner, a cleaner system, and a method for controlling the cleaner system, and more particularly, to a cleaner configured to suck outside dust, a cleaner system including a cleaner and a cleaner station configured to suck dust stored in the cleaner into the cleaner station, and a method for controlling the cleaner system.

BACKGROUND ART

In general, a cleaner refers to an electrical appliance that draws in small garbage or dust by sucking air using electricity and fills a dust bin provided in a product with the garbage or dust. Such a cleaner is generally called a vacuum cleaner.

The cleaners may be classified into a manual cleaner which is moved directly by a user to perform a cleaning operation, and an automatic cleaner which performs a cleaning operation while autonomously traveling. Depending on the shape of the cleaner, the manual cleaners may be classified into a canister cleaner, an upright cleaner, a handy cleaner, a stick cleaner, and the like.

The canister cleaners were widely used in the past as household cleaners. However, recently, there is an increasing tendency to use the handy cleaner and the stick cleaner in which a dust bin and a cleaner main body are integrally provided to improve convenience of use.

In the case of the canister cleaner, a main body and a suction port are connected by a rubber hose or pipe, and in some instances, the canister cleaner may be used in a state in which a brush is fitted into the suction port.

The handy cleaner (hand vacuum cleaner) has maximized portability and is light in weight. However, because the handy cleaner has a short length, there may be a limitation to a cleaning region. Therefore, the handy cleaner is used to clean a local place such as a desk, a sofa, or an interior of a vehicle.

A user may use the stick cleaner while standing and thus may perform a cleaning operation without bending his/her waist. Therefore, the stick cleaner is advantageous for the user to clean a wide region while moving in the region. The handy cleaner may be used to clean a narrow space, whereas the stick cleaner may be used to clean a wide space and also used to a high place that the user's hand cannot reach. Recently, modularized stick cleaners are provided, such that types of cleaners are actively changed and used to clean various places.

In addition, recently, a robot cleaner, which autonomously performs a cleaning operation without a user's manipulation, is used. The robot cleaner automatically cleans a zone to be cleaned by sucking foreign substances such as dust from the floor while autonomously traveling in the zone to be cleaned.

However, the conventional handy cleaner, the stick cleaner, and the robot cleaner have a dust bin having a small capacity, and thus, there was inconvenience for the user to empty the dust bin all the time.

In addition, there was a problem that when emptying the dust bin, dust scattered and posed a harmful impact on the health of the user.

Further, there was a problem that when the residual dust is not removed from the dust bin, the residual dust deteriorated a suction force of the cleaner.

Moreover, there was a problem that an offensive odor was caused by the residue when the residual dust is not removed from the dust bin.

As a patent document 1, Korean Patent No. 10-2020-0074001 is proposed. The patent document 1 discloses a cleaning apparatus including a vacuum cleaner and a docking station.

The cleaning apparatus of the patent document 1 includes a vacuum cleaner including a dust collecting chamber in which foreign substances are collected, and a docking station connected to the dust collecting chamber to remove the foreign substances collected in the dust collecting chamber. The dust collecting chamber is configured to be docked to the docking station, and the docking station includes a suction device configured to suck the foreign substances and air in the dust collecting chamber docked to the docking station.

In addition, the patent document 1 includes a collector disposed in the docking station and configured to collect foreign substances. According to the patent document 1, when the suction device disposed in the docking station is driven, the suction device draws in foreign substances collected in the dust collecting chamber by a negative pressure, and collects the foreign substances to the collector so as to clean the dust collecting chamber.

In the course of collecting dust, there may be some cases where thin and long foreign substances such as strands of hair are trapped and hung long between the dust collecting chamber of the cleaner and the docking station, since they cannot be collected by the suction force of the docking station. The strands of hair may be attached to an inner circumferential surface of the dust collecting chamber by a frictional force, or may be placed in the dust collecting chamber or a structure of the connecting portion of the docking station.

Therefore, after the dust collecting process of the docking station ends, the user could not help but touching the foreign substances (hereinafter, residual dust) attached around the dust collecting chamber and hung long and exposed with hands again in the course of using the vacuum cleaner, and it is inconvenient for the user to remove the residual dust firsthand using wet tissues and the like.

As a patent document 2, Korean Patent No. 10-2208334 is suggested. The patent document 2 discloses a cleaning device including a vacuum cleaner and a docking station.

The patent document 2 proposes a cleaning device including a docking station that allows foreign substances in a dust collecting container of a vacuum cleaner to be automatically discharged by providing an irregular suction airflow.

In order to solve the above-mentioned problems, the patent document 2 includes a suction device configured to move air from the dust collecting container to the inside of the docking station, and a flow adjusting device configured to open or close the suction flow path. The controller may control the suction device, or may control the flow adjusting device to periodically open and close the suction flow path during the operation of the suction device. According to the patent document 2, it is advantageous that an irregular suction airflow is generated inside the air flow path such that foreign substances in the dust collecting container are efficiently discharged, as the air flow path is opened or closed by the flow adjusting device.

However, even if in the case of generating the irregular suction airflow by adjusting a flow rate as disclosed in the patent document 2, the final goal is to collect foreign substances such as strands of hair and the like hung in the dust collecting container into the docking station. At this time, there is a problem that a high dust collecting efficiency compared to the energy taken in driving the flow adjusting device cannot be expected since a route, through which the foreign substances hung in the dust collecting container move to the dust collecting container inside the docking station, is long.

In addition, there is a problem that as the flow adjusting device is provided separately, a volume of the station itself increases.

As a patent document 3, US Patent No. 2021-0030244 is suggested. The patent document 3 discloses a cleaning system configured to remove debris from the robotic cleaner.

The patent document 3 provides a station, and allows a handheld vacuum to be coupled to one side of the station and a robotic cleaner to be coupled to the other side of the station. A debris bin of the handheld vacuum and a debris bin of the robotic cleaner are in communication with each other, and when a vacuum motor of the robotic cleaner is driven, debris held in the debris bin of the robotic cleaner is moved to the handheld vacuum while evacuating the debris bin of the robotic cleaner.

However, since a flow direction of the debris in the patent document 3 is maintained to be one direction, there is a problem that foreign substances such as strands of hair and the like hung firmly in the debris bin, as described above, cannot be wiped off from the debris bin by the patent document 3 as well.

DISCLOSURE

Technical Problem

The present disclosure has been made in order to solve the above-mentioned problems of the cleaner station and the method for controlling the cleaner station in the related art, and an object of the present disclosure is to remove foreign substances such as strands of hair which remain to be trapped on an open end of the dust bin after dust held in the dust bin is evacuated.

In addition, an object of the present disclosure is to remove foreign substances such as strands of hair that may remain to be trapped on an open end of the cleaner while minimizing energy consumption in the removal of the foreign substances.

Further, an object of the present disclosure is to allow reception and transmission of information between the cleaner station and the cleaner, without requiring an additional communication module.

Moreover, an object of the present disclosure is to allow the cleaner to determine whether the cleaner is coupled to a charging holder having a charging function only or a charging holder having a dust collecting function in addition to the charging function (the cleaner station according to the present disclosure) when the cleaner is coupled to the cleaner station.

Technical Solution

One embodiment is a cleaner system, including: a cleaner comprising a dust bin and a suction motor configured to generate a suction force so that air containing dust is introduced into the dust bin; and a cleaner station to which the cleaner is coupled.

The cleaner station may include: a coupling part allowing the cleaner to seat therein and to couple thereto; a suction flow path through which dust discharged from the dust bin flows; a housing in which the coupling part is provided and an internal space configured to accommodate the suction flow path is provided; a dust collecting motor disposed below the suction flow path in the internal space and configured to provide a suction force to the dust bin through the suction flow path; and a door disposed in the coupling part and configured to open or close a dust passage hole formed in one end of the suction flow path.

In addition, the cleaner station may be configured to open the door and to drive the dust collecting motor for a predetermined time of dust collection so as to collect dust in the dust bin into an inside of the cleaner station when the cleaner is coupled to the coupling part, and the cleaner may be configured to drive the suction motor in a state in which the door is open after the driving of the dust collecting motor is finished.

In addition, when the cleaner is coupled to the coupling part and a battery terminal of the cleaner is electrically connected to a charging terminal of the cleaner station, the cleaner station may be configured to provide a pulse signal to the cleaner through the battery terminal.

At this time, the pulse signal may be a signal generated by turning on or off application of a charging voltage for charging the cleaner at a predetermined interval a predetermined number of times.

Upon receiving the pulse signal, the cleaner may be configured to drive the suction motor after a predetermined waiting time elapses.

In the cleaner station, an opening angle of the door may be adjusted to a predetermined angle, before the suction motor is driven after the driving of the dust collecting motor is finished.

At this time, the predetermined angle may be smaller than an angle at which the door is opened during the driving of the dust collecting motor.

Meanwhile, the dust bin may include: a dust bin main body taking a form of a cylinder and provided in a form in which one side in a longitudinal direction is opened; a discharge cover rotatably coupled to the one open side of the dust bin main body; and a torsion spring disposed on a rotational axis of the discharge cover rotating about the dust bin main body and configured to apply an elastic force in a direction in which the discharge cover is opened.

Another embodiment is a cleaner system, including: a cleaner comprising a dust bin and a suction motor configured to generate a suction force so that air containing dust is introduced into the dust bin; and a cleaner station to which the cleaner is coupled.

At this time, the cleaner station may include: a coupling part allowing the cleaner to seat therein and to couple thereto; a suction flow path through which dust discharged from the dust bin flows; a housing in which the coupling part is provided and an internal space configured to accommodate the suction flow path is provided; a dust collecting motor disposed below the suction flow path in the internal space and configured to provide a suction force to the dust bin through the suction flow path; and a charging terminal disposed in the coupling part and configured to connect to a battery terminal of the cleaner to supply a charging voltage for charging a battery of the cleaner.

In addition, the cleaner station may be configured to provide a pulse signal to the cleaner through the battery terminal when the cleaner is coupled to the coupling part.

At this time, the pulse signal may be a signal generated by turning on or off application of the charging voltage at a predetermined interval a predetermined number of times.

Upon receiving the pulse signal, the cleaner may be configured to drive the suction motor after a predetermined waiting time elapses.

Still another embodiment is a cleaner, including: a dust bin configured to store dust therein; a suction motor configured to generate a suction force so that air containing dust is introduced into the dust bin; a battery connected to the suction motor and configured to supply power; a battery terminal to which a charging voltage for charging the battery is applied; and a cleaner control unit configured to control drive of the suction motor.

At this time, the cleaner control unit may be configured to control whether to drive the suction motor according to kinds of signals applied to the battery terminal, when the battery terminal is coupled to a charging terminal provided outside the cleaner station.

In addition, the cleaner control unit may be configured to drive the suction motor, when a pulse signal is applied to the battery terminal.

At this time, the pulse signal may be a signal generated by turning on or off application of a charging voltage applied to the battery terminal at a predetermined interval a predetermined number of times.

In addition, the cleaner control unit may be configured to drive the suction motor after a predetermined waiting time elapses since when the pulse signal is applied to the battery terminal.

In addition, the cleaner control unit may be configured to set the waiting time so that the suction motor is driven after drive of the dust collecting motor provided in the cleaner station is finished.

Still another embodiment is a method for controlling a cleaner system comprising a cleaner and a cleaner station to which the cleaner is coupled, the cleaner comprising a dust bin and a suction motor configured to generate a suction force to the dust bin, and the cleaner station comprising a door configured to open or close a dust passage hole provided to allow dust in the dust bin to pass therethrough, including: providing a pulse signal from the cleaner station to the cleaner when the cleaner is coupled to the cleaner station; capturing dust from the dust bin into an inside of the cleaner station by driving a dust collecting motor provided in the cleaner station for a predetermined time of dust collection when a discharge cover of the dust bin and the door are opened; and driving the suction motor when the dust collecting motor stops after the time of dust collection elapses.

At this time, in the providing a pulse signal, when a battery terminal provided in the cleaner is electrically connected to a charging terminal provided in the cleaner station, a pulse signal may be provided to the cleaner through the battery terminal, and the pulse signal may be a signal generated by turning on or off application of a charging voltage for charging the cleaner at a predetermined interval a predetermined number of times.

Meanwhile, in the driving the suction motor, upon receiving the pulse signal, the suction motor may be driven after a predetermined waiting time elapses.

In addition, in the driving the suction motor, the door may be moved in a direction of closing the door until the door is in an opened state at a predetermined angle before driving the suction motor, and in the opened state of the door at the predetermined angle, the suction motor may be driven.

At this time, the predetermined angle may have a size smaller than an angle at which the door is opened in the capturing dust into an inside of the cleaner station.

Advantageous Effect

According to the present disclosure, strands of hair, which may remain in a state of being trapped on an open end of the dust bin even after collecting dust held in the dust bin, may be removed by driving the suction motor of the cleaner. Therefore, convenience for the user to hygienically maintain the cleaner is provided.

In addition, according to the present disclosure, in removing residual foreign substances such as strands of hair and the like, the cleaner may suck the residual foreign substances into the dust bin of the cleaner by driving only the suction motor of the cleaner in a state in which the dust collecting motor is not driven. Therefore, time and power consumed in removing the residual foreign substances may be minimized while effectively removing the residual foreign substances.

Furthermore, according to the present disclosure, it is advantageous in that the time for which the consumer is exposed to the operational noise may be reduced since the cleaner is driven for a short period of time to remove the residual foreign substances.

Moreover, according to the present disclosure, the residual foreign substances which are hard to remove only by applying the suction force, that are, the residual foreign substances which must be removed manually by the user are sucked into the dust bin again and held therein, the user may be provided with convenience which allows the user to manage debris later firsthand.

Besides, according to the present disclosure, kinds of the charging holder to which the cleaner is coupled may be identified through a pulse signal that the cleaner station transmits to the cleaner. Therefore, the cleaner by itself may determine whether to perform subsequent operations for sucking back the above-mentioned residual foreign substances.

In addition, according to the present disclosure, the communication between the cleaner station and the cleaner is performed through a power line that provides power, therefore, the reception and transmission of information between the cleaner station and the cleaner may be made possible without installing an additional communication module.

MODE FOR INVENTION

Figure 1:
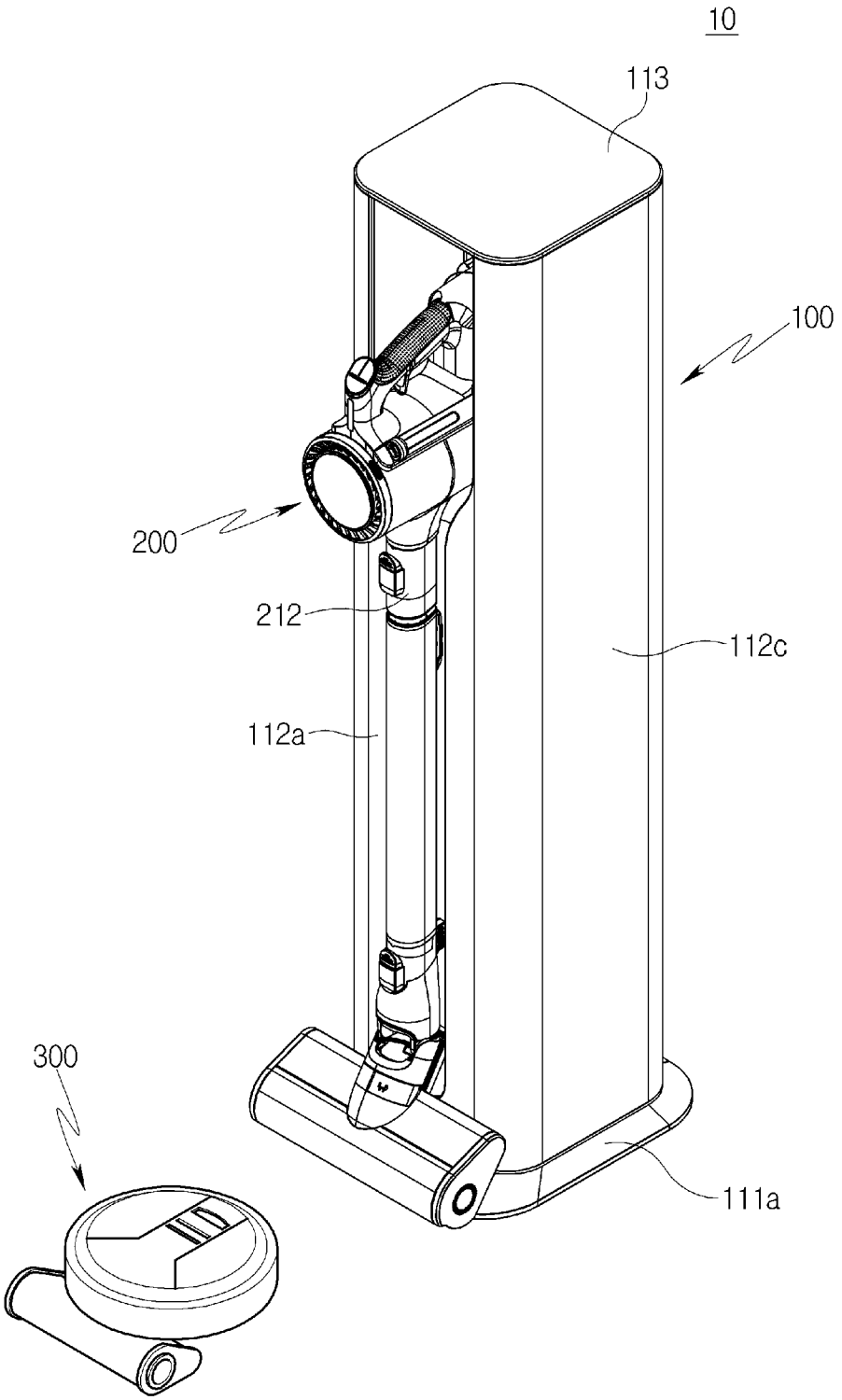
FIG. 1 is a perspective view of a cleaner system configured with a cleaner and a cleaner station according to an embodiment of the present disclosure.

Hereinafter, exemplary embodiments of the present disclosure will be described in detail with reference to the accompanying drawings.

The present disclosure may be variously modified and may have various embodiments, and particular embodiments illustrated in the drawings will be specifically described below. The description of the embodiments is not intended to limit the present disclosure to the particular embodiments, but it should be interpreted that the present disclosure is to cover all modifications, equivalents and alternatives falling within the spirit and technical scope of the present disclosure.

The terminology used herein is used for the purpose of describing particular embodiments only and is not intended to limit the present disclosure. Singular expressions may include plural expressions unless clearly described as different meanings in the context.

Unless otherwise defined, all terms used herein, including technical or scientific terms, may have the same meaning as commonly understood by those skilled in the art to which the present disclosure pertains. The terms such as those defined in a commonly used dictionary may be interpreted as having meanings consistent with meanings in the context of related technologies and may not be interpreted as ideal or excessively formal meanings unless explicitly defined in the present application.

Figure 2:
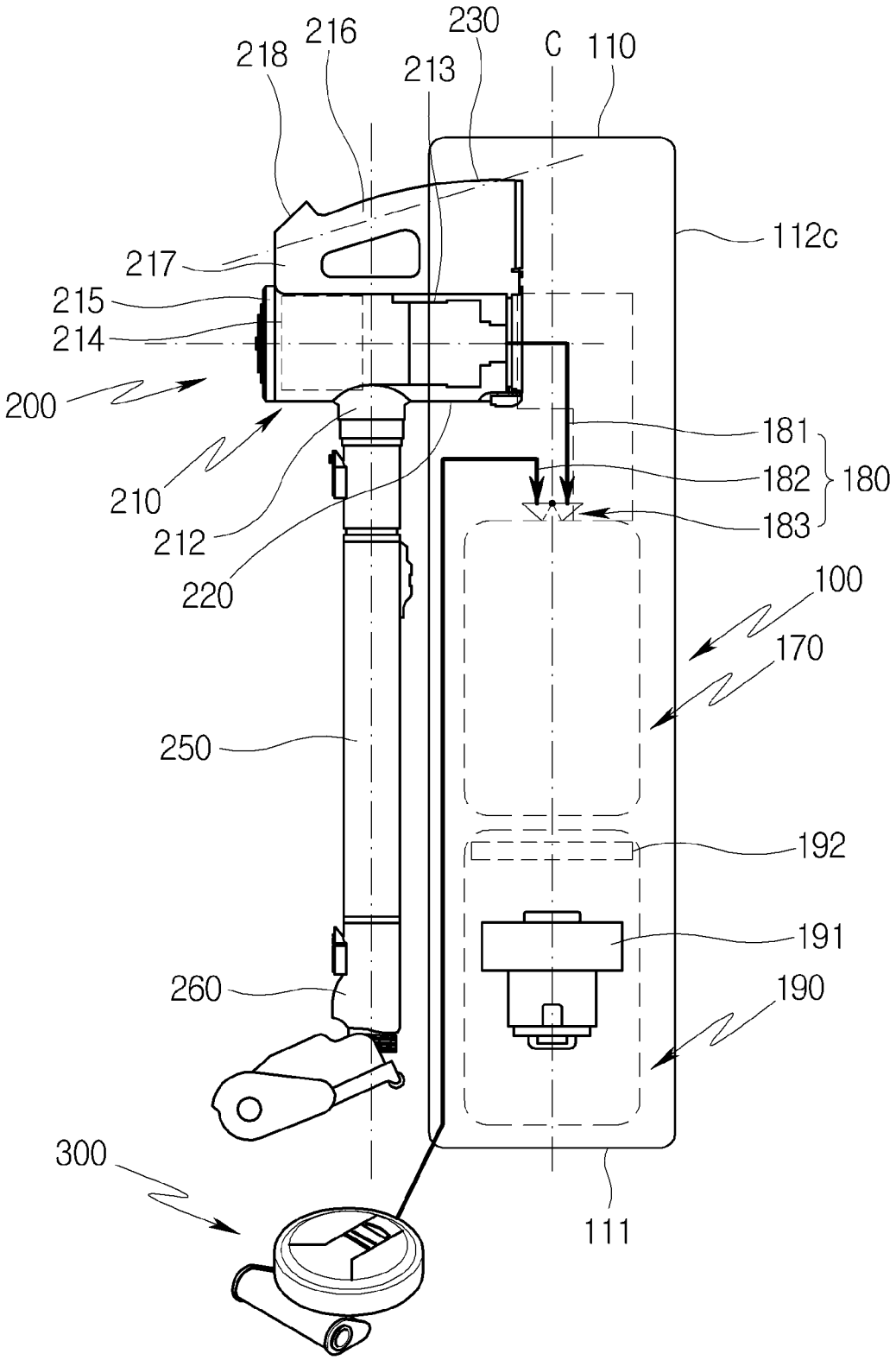
FIG. 2 is a schematic view of a configuration of a cleaner system according to an embodiment of the present disclosure.

FIG. 1 is a perspective view of a cleaner system configured with a cleaner and a cleaner station according to an embodiment of the present disclosure, and FIG. 2 is a schematic view of a configuration of a cleaner system according to an embodiment of the present disclosure.

Referring to FIGS. 1 and 2, a cleaner system 10 according to an embodiment of the present disclosure may include a cleaner station 100 and cleaners 200 and 300. In this case, the cleaners 200 and 300 may include a first cleaner 200 and a second cleaner 300. Meanwhile, the present embodiment may be carried out without some of the above-mentioned components and does not exclude additional components.

The cleaner system 10 may include the cleaner station 100. The first cleaner 200 and the second cleaner 300 may be coupled to the cleaner station 100. Specifically, a main body of the first cleaner 200 may be coupled to a lateral surface of the cleaner station 100. The second cleaner 300 may be coupled to a lower portion of the cleaner station 100. The cleaner station 100 may remove dust from a dust bin 220 of the first cleaner 200. The cleaner station 100 may remove dust from a dust bin (not illustrated) of the second cleaner 300.

Figure 3:
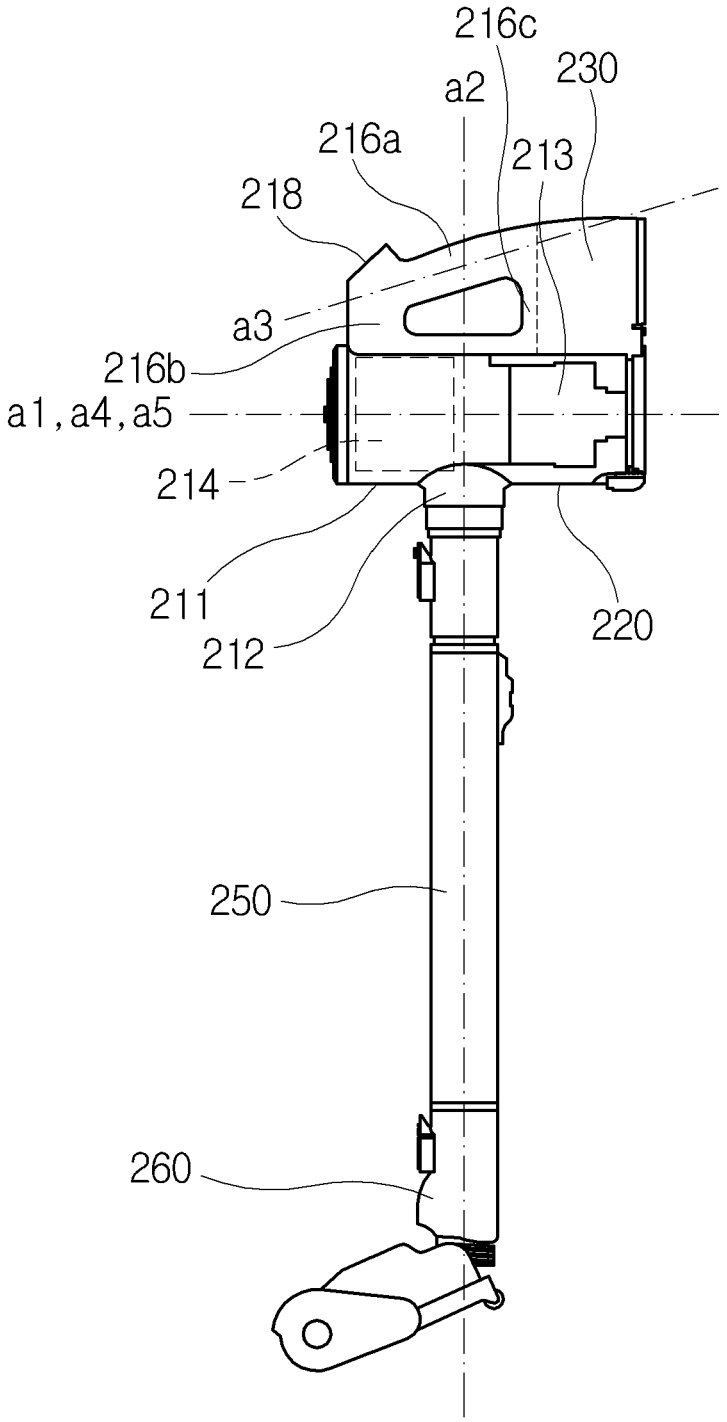
FIG. 3 is a view for describing a cleaner of a cleaner system according to an embodiment of the present disclosure.
Figure 4:
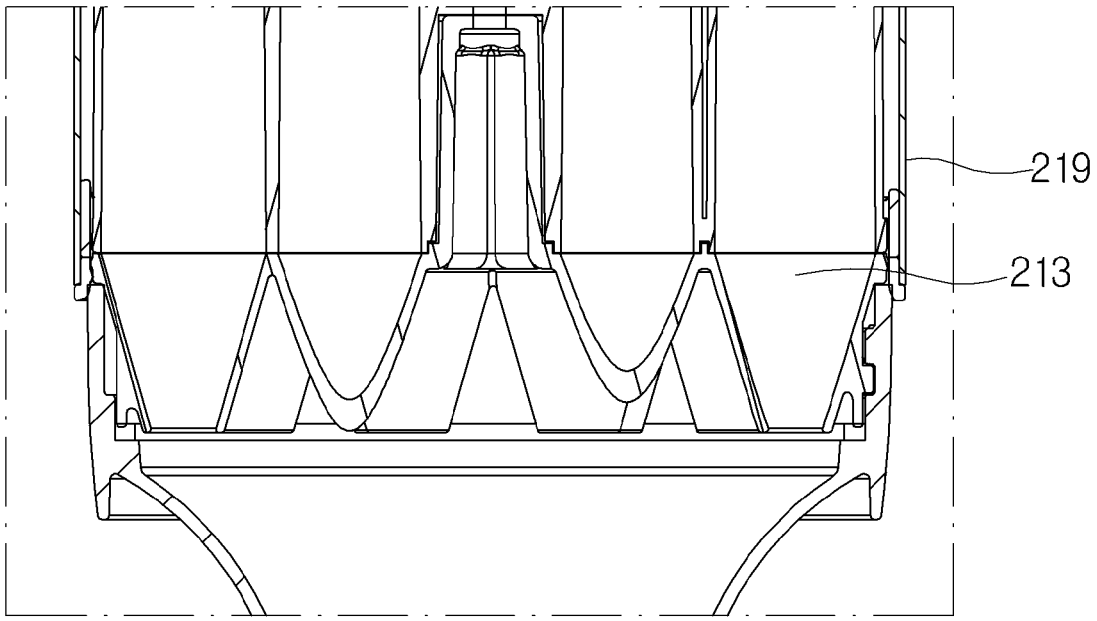
FIG. 4 is a view for describing a dust separating part and a cyclone filter of a first cleaner according to an embodiment of the present disclosure.
Figure 5A:
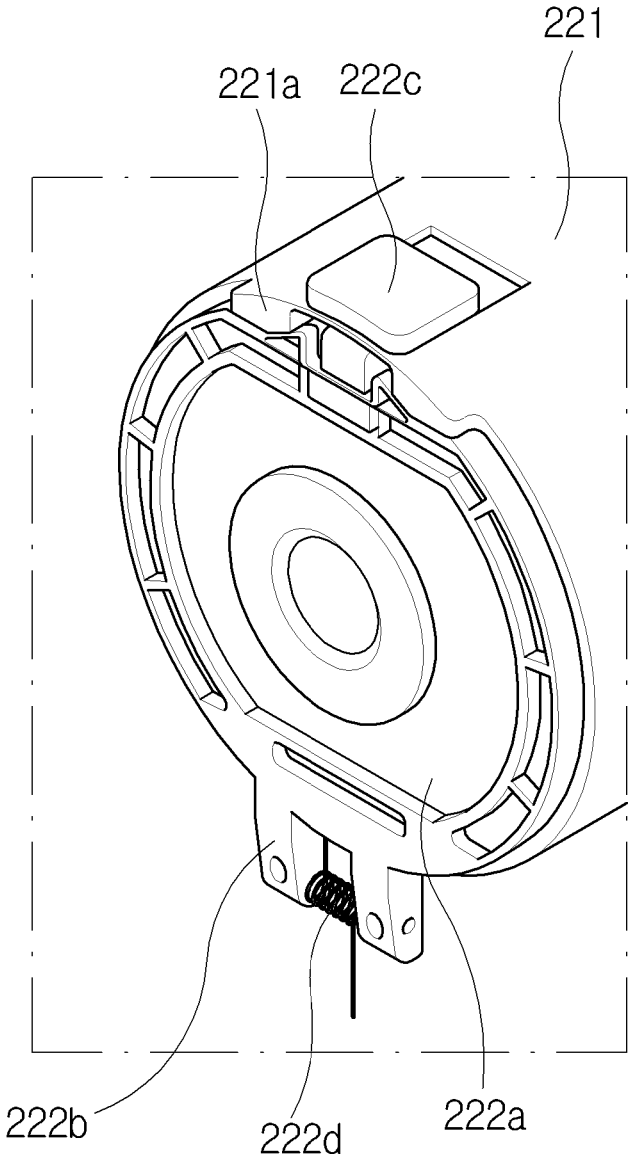
FIG. 5*a* is a view for describing a lower portion of a dust bin of a first cleaner according to an embodiment of the present disclosure.
Figure 5B:
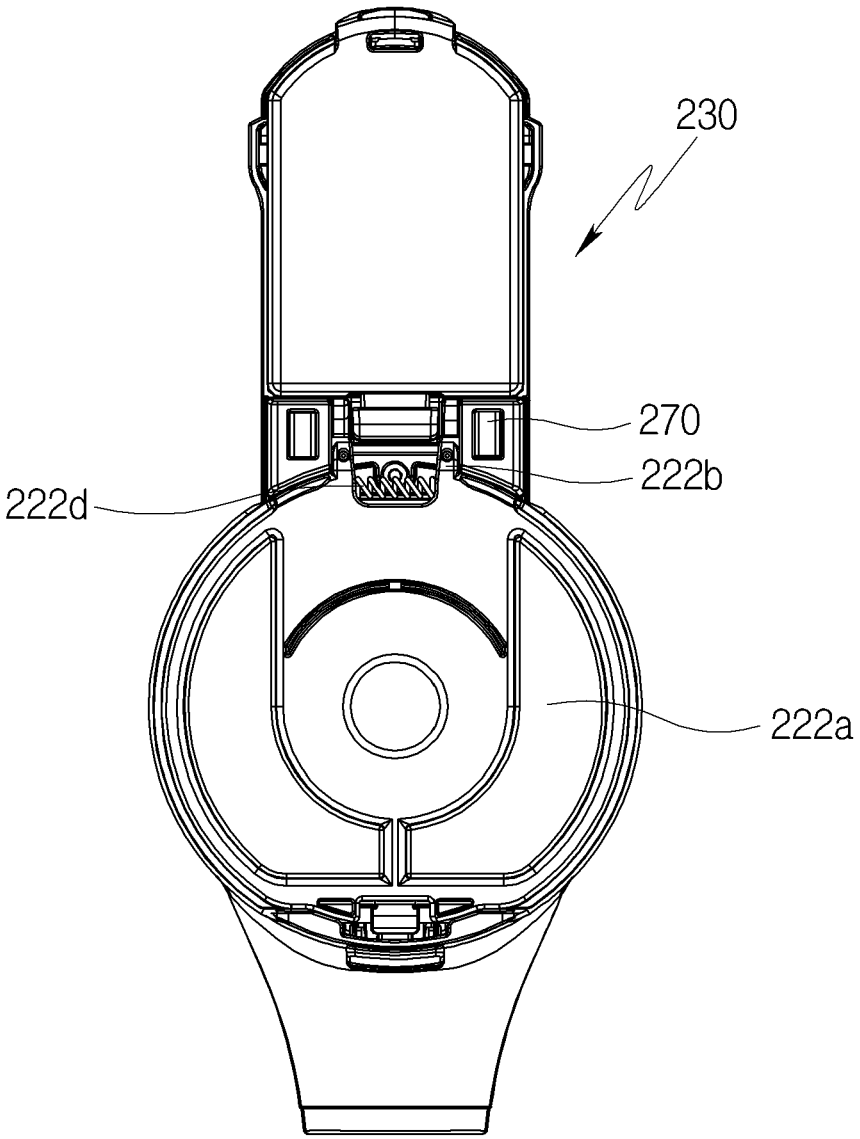
FIG. 5*b* is a view for describing a battery terminal of a first cleaner according to an embodiment of the present disclosure.

Meanwhile, FIG. 3 is a view for describing the cleaner of the cleaner system according to an embodiment of the present disclosure, FIG. 4 is a view for describing a dust separating part and a cyclone filter of the first cleaner according to an embodiment of the present disclosure, FIG. 5*a* is a view for describing the lower portion of the dust bin of the first cleaner according to an embodiment of the present disclosure, and FIG. 5*b* is a view for describing a battery terminal of the first cleaner according to an embodiment of the present disclosure.

First, a structure of the first cleaner 200 will be described below with reference to FIGS. 1 to 5.

The first cleaner 200 may mean a cleaner configured to be manually operated by a user. For example, the first cleaner 200 may mean a handy cleaner or a stick cleaner.

The first cleaner 200 may be mounted on the cleaner station 100. The first cleaner 200 may be supported by the cleaner station 100. The first cleaner 200 may be coupled to the cleaner station 100.

Meanwhile, in the embodiment of the present disclosure, directions may be defined on the basis of a state in which a bottom surface (lower surface) of the dust bin 220 and a bottom surface (lower surface) of a battery housing 230 are placed on a ground surface.

In this case, a forward direction may mean a direction in which a suction part 212 is disposed based on a suction motor 214, and a rear direction may mean a direction in which a handle 216 is disposed. Further, on the basis of a state in which the suction part 212 is viewed from the suction motor 214, a right direction may refer to a direction in which a component is disposed at the right, and a left direction may refer to a direction in which a component is disposed at the left. In addition, in the embodiment of the present disclosure, upper and lower sides may be defined in a direction perpendicular to the ground surface on the basis of the state in which the bottom surface (lower surface) of the dust bin 220 and the bottom surface (lower surface) of the battery housing 230 are placed on the ground surface.

The first cleaner 200 may include a main body 210. The main body 210 may include a main body housing 211, the suction part 212, a dust separating part 213, the suction motor 214, an air discharge cover 215, the handle 216, and an operating part 218.

The main body housing 211 may define an external appearance of the first cleaner 200. The main body housing 211 may provide a space that may accommodate therein the suction motor 214 and a filter (not illustrated). The main body housing 211 may be formed in a shape similar to a cylinder.

The suction part 212 may protrude outward from the main body housing 211. For example, the suction part 212 may be formed in a cylindrical shape with an opened inside. The suction part 212 may be coupled to an extension tube 250. The suction part 212 may provide a flow path (hereinafter, referred to as a 'suction flow path') through which air containing dust may flow.

Meanwhile, in the present embodiment, an imaginary line may be defined to penetrate the inside of the suction part 212 having a cylindrical shape. That is, an imaginary suction flow path through line a2 may be formed to penetrate the suction flow path in a longitudinal direction.

The dust separating part 213 may communicate with the suction part 212. The dust separating part 213 may separate dust introduced into the dust separating part 213 through the suction part 212. An internal space of the dust separating part 213 may communicate with an internal space of the dust bin 220.

For example, the dust separating part 213 may have two or more cyclone parts capable of separating dust using a cyclone flow. Further, the internal space of the dust separating part 213 may communicate with the suction flow path. Therefore, the air and the dust, which are introduced through the suction part 212, spirally flow along an inner circumferential surface of the dust separating part 213. Therefore, the cyclone flow may be generated in the internal space of the dust separating part 213.

The dust separating part 213 is communicated with the suction part 212, and the dust separating part 213 is configured to apply a principle of a dust collector using a centrifugal force so as to separate dust sucked into the main body 2 through the suction part 212.

For example, the dust separating part 213 may have one or more cyclones capable of separating dust using a cyclone flow. Further, the cyclones may communicate with the suction part 212. The air and the dust, which are introduced through the suction part 212, spirally flow along an inner circumferential surface of cyclones.

The dust separating part 213 may further include a second cyclone 330 that secondarily separates dust from the air discharged from the cyclone. At this instance, the second cyclone 330 may be disposed inside the cyclone to minimize a size of the dust separating part 213. The second cyclone 330 may include a plurality of cyclone bodies arranged in parallel. The air discharged from the cyclone may pass through the plurality of cyclone bodies in a split manner.

At this instance, an axis of the cyclonic flow of the second cyclone 330 may also extend vertically, an axis of the cyclonic flow of the cyclone and the axis of the cyclonic flow of the second cyclone may be coaxial in a vertical direction, and the axes may be collectively referred to as the axes of the cyclone flow of the dust separating part 213. Meanwhile, in the present embodiment, an imaginary cyclone line a4 may be formed with respect to axes of the cyclone flow.

The dust separating part 213 may further include a cyclone filter 219 disposed to surround the second cyclone 330. The cyclone filter 219 may be formed in a cylindrical shape, for example, and guide air separated from dust in the cyclone to the second cyclone 330. The cyclone filter 219 may filter dust while the air passes therethrough.

To this end, the cyclone filter 219 may include a mesh portion having a plurality of holes. The mesh portion may be formed of a metal material, though not limited thereto.

The suction motor 214 may generate a suction force for sucking air containing dust. The suction motor 214 may be accommodated in the main body housing 211. The suction motor 214 may generate the suction force by means of a rotation so that air can be introduced into the dust bin 220. For example, the suction motor 214 may be formed in a shape similar to a cylindrical shape.

Meanwhile, in the present embodiment, an imaginary suction motor axis a1 which extends a rotational axis of the suction motor 214 may be formed.

The air discharge cover 215 may be disposed at one side in the axial direction of the main body housing 211. The air discharge cover 215 may accommodate a filter for filtering air. For example, an HEPA filter may be accommodated in the air discharge cover 215.

The air discharge cover 215 may have an air discharge port for discharging the air introduced by the suction force of the suction motor 214.

A flow guide may be disposed on the air discharge cover 215. The flow guide may guide a flow of the air to be discharged through the air discharge port.

The handle 216 may be grasped by the user. The handle 216 may be disposed at a rear side of the suction motor 214. For example, the handle 216 may be formed in a shape similar to a cylindrical shape. Alternatively, the handle 216 may be formed in a curved cylindrical shape. The handle 216 may be disposed at a predetermined angle with respect to the main body housing 211, the suction motor 214, or the dust separating part 213.

The handle 216 may include a grip portion 216*a* formed in a column shape so that the user may grasp the grip portion 216*a*, a first extension portion 216*b* connected to one end in the longitudinal direction (axial direction) of the grip portion 216*a* and extending toward the suction motor 214, and a second extension portion 216*c* connected to the other end in the longitudinal direction (axial direction) of the grip portion 216*a* and extending toward the dust bin 220.

Meanwhile, in the present embodiment, an imaginary grip portion through line a3, which extends along a longitudinal direction (axial direction of a column) of the grip portion 216*a* and penetrates the grip portion 216*a*, may be formed.

For example, the imaginary grip portion through line a3 may be an imaginary line that is formed inside the cylindrical handle 216, and may be an imaginary line which is formed parallel to at least some of an outer lateral surface (outer circumferential surface) of the grip portion 216*a*.

An upper surface of the handle 216 may define an external appearance of a part of an upper surface of the cleaner 200. Therefore, it is possible to prevent a component of the cleaner 200 from coming into contact with the user's arm when the user grasps the handle 216.

The first extension portion 216*b* may extend from the grip portion 216*a* toward the main body housing 211 or the suction motor 214. At least a part of the first extension portion 216*b* may extend in a horizontal direction.

The second extension portion 216*c* may extend from the grip portion 216*a* toward the dust bin 220. At least a part of the second extension portion 216*c* may extend in the horizontal direction.

The operating part 218 may be disposed on the handle 216. The operating part 218 may be disposed on an inclined surface formed in an upper region of the handle 216. The user may input an instruction to operate or stop the cleaner 200 through the operating part 218.

The first cleaner 200 may include the dust bin 220. The dust bin 220 may communicate with the dust separating part 213. The dust bin 220 may store the dust separated in the dust separating part 213.

The dust bin 220 may include a dust bin main body 221, a discharge cover 222, a dust bin compression lever 223, and a compression member (not illustrated).

The dust bin main body 221 may provide a space capable of storing the dust separated by the dust separating part 213. For example, the dust bin main body 221 may be formed in a shape similar to a cylindrical shape.

Meanwhile, in the present embodiment, an imaginary dust bin through line a5, which penetrates an inside (internal space) of the dust bin main body 221 and extends along a longitudinal direction (axial direction of the cylindrical dust bin main body 221) of the dust bin main body 221, may be formed.

A part of a lower surface (bottom surface) of the dust bin main body 221, which is one side in a longitudinal direction of the dust bin main body 221, may be opened. In addition, a lower extension portion 221*a* may be formed on the lower surface (bottom surface) of the dust bin main body 221. The lower extension portion 221*a* may be formed to block a part of the lower surface of the dust bin main body 221.

The dust bin 220 may include the discharge cover 222. The discharge cover 222 may be disposed on a lower surface of the dust bin 220.

The discharge cover 222 may be provided to open or close one end in a longitudinal direction of the dust bin main body 221. In more detail, the discharge cover 222 is rotatably coupled to an opened side of the dust bin main body 221, and may selectively open or close the lower side of the dust bin 220.

The discharge cover 222 may include a cover main body 222*a* and a hinge part 222*b*. The cover main body 222*a* may be formed to block a part of the lower surface of the dust bin main body 221. The cover main body 222*a* may be rotated downward about the hinge part 222*b*. The hinge part 222*b* may be disposed adjacent to a battery housing 230.

The dust bin 220 may include a torsion spring 222*d*. The torsion spring 22*d* is disposed on a rotational axis of the discharge cover 222 which rotates about the dust bin main body 221, and may apply an elastic force (or a restoration force) in an opening direction of the discharge cover 222. Therefore, when the discharge cover 222 is separated from the dust bin main body 221, the cover main body 222*a* may be supported from the dust bin main body 221, in a state of being rotated at more than a certain angle about the hinge part 222*b*, by the elastic force of the torsion spring 222*d*.

The discharge cover 222 may be coupled to the dust bin 220 by a hook engagement. Meanwhile, the discharge cover 222 may be separated from the dust bin 220 by means of a coupling lever 222*c*. The coupling lever 222*c* may be disposed at a front side of the dust bin. Specifically, the coupling lever 222*c* may be disposed on an outer surface at the front side of the dust bin 220. When an external force is applied to the coupling lever 222*c*, the coupling lever 222*c* may elastically deform a hook extending from the cover main body 222*a* in order to release the hook engagement between the cover main body 222*a* and the dust bin main body 221.

When the discharge cover 222 is closed, the lower surface of the dust bin 220 may be blocked (sealed) by the discharge cover 222 and the lower extension portion 221*a*.

The dust bin 220 may further include the dust bin compression lever 223. (Refer to FIG. 8) The dust bin compression lever 223 may be disposed outside the dust bin 220 or the dust separating part 213. The dust bin compression lever 223 may be disposed outside the dust bin 220 or the dust separating part 213 so as to be movable upward and downward. The dust bin compression lever 223 may be connected to the compression member (not illustrated). When the dust bin compression lever 223 is moved downward by an external force, the compression member (not illustrated) may also be moved downward as well. Therefore, it is possible to provide convenience for the user. The compression member (not illustrated) and the dust bin compression lever 223 may return back to original positions by an elastic member (not illustrated). Specifically, when the external force applied to the dust bin compression lever 223 is eliminated, the elastic member may move the dust bin compression lever 223 and the compression member (not illustrated) upward.

The compression member (not illustrated) may be disposed in the dust bin main body 221. The compression member may move in the internal space of the dust bin main body 221. Specifically, the compression member may move upward and downward in the dust bin main body 221. Therefore, the compression member may compress the dust in the dust bin main body 221 downward. In addition, when the discharge cover 222 is separated from the dust bin main body 221 and thus the lower side of the dust bin 220 is opened, the compression member may move from an upper side of the dust bin 220 to the lower side of the of the dust bin 220, thereby removing foreign substances such as residual dust in the dust bin 220. Therefore, it is possible to improve the suction force of the cleaner by preventing the residual dust from remaining in the dust bin 220. Further, it is possible to remove an offensive odor caused by the residual dust by preventing the residual dust from remaining in the dust bin 220.

The first cleaner 200 may include the battery housing 230. A battery 240 may be accommodated in the battery housing 230. The battery housing 230 may be disposed at a lower side of the handle 216. For example, the battery housing 230 may have a hexahedral shape opened at a lower side thereof. A rear surface of the battery housing 230 may be connected to the handle 216.

The battery housing 230 may include an accommodation portion which may be opened downward. The battery 240 may be attached or detached through the accommodation portion of the battery housing 220.

In the battery housing 230, battery terminals 270 which are exposed to the outside may be provided (Refer to FIG. 5*b*). When the battery terminals 270 and charging terminals 128 are coupled to each other, electric power may be supplied from the cleaner station 100 to the battery 240 of the first cleaner 200 through the battery terminals 270. The battery terminals 270 may be spaced apart from each other in left and right directions on the lower surface of the battery housing 230, and a gap distance between the battery terminals 270 may be substantially the same as a gap distance between the charging terminals 128.

The cleaner 200 may include the battery 240.

For example, the battery 240 may be separably coupled to the first cleaner 200. The battery 240 may be separably coupled to the battery housing 230. For example, the battery 240 may be inserted into the battery housing 230 from the lower side of the battery housing 230. The above-mentioned configuration may improve portability of the first cleaner 200.

Alternatively, the battery 240 may be integrally provided in the battery housing 230. In this case, a lower surface of the battery 240 is not exposed to the outside.

The battery 240 may supply power to the suction motor 214 of the first cleaner 200. The battery 240 may be disposed on a lower portion of the handle 216. The battery 240 may be disposed at a rear side of the dust bin 220. That is, the suction motor 214 and the battery 240 may be disposed so as not to overlap each other in the upward and downward direction and disposed at different disposition heights. On the basis of the handle 216, the suction motor 214, which is heavy in weight, is disposed at a front side of the handle 216, and the battery 240, which is heavy in weight, is disposed at the lower side of the handle 216, such that an overall weight of the first cleaner 200 may be uniformly distributed. Therefore, it is possible to prevent stress from being applied to the user's wrist when the user grasps the handle 216 and performs a cleaning operation.

In a case in which the battery 240 is coupled to the battery housing 230 according to an embodiment, the lower surface of the battery 240 may be exposed to the outside. Because the battery 240 may be placed on the floor when the first cleaner 200 is placed on the floor, the battery 240 may be immediately separated from the battery housing 230. In addition, because the lower surface of the battery 240 is exposed to the outside and thus in direct contact with air outside the battery 240, performance of cooling the battery 240 may be improved.

Meanwhile, in a case in which the battery 240 is fixed integrally to the battery housing 230, the number of structures for attaching or detaching the battery 240 and the battery housing 230 may be reduced, and as a result, it is possible to reduce an overall size of the first cleaner 200 and a weight thereof.

The first cleaner 200 may include the extension tube 250. The extension tube 250 may communicate with a cleaning module 260. The extension tube 250 may communicate with the main body 210. The extension tube 250 may communicate with the suction part 214 of the main body 210. The extension tube 250 may be formed in a long cylindrical shape.

The main body 210 may be connected to the extension tube 250. The main body 210 may be connected to the cleaning module 260 through the extension tube 250. The main body 210 may generate the suction force by means of the suction motor 214 and provide the suction force to the cleaning module 260 through the extension tube 250. The outside dust may be introduced into the main body 210 through the cleaning module 260 and the extension tube 250.

The first cleaner 200 may include the cleaning module 260. The cleaning module 260 may communicate with the extension tube 250. Therefore, the outside air may be introduced into the main body 210 of the first cleaner 200 via the cleaning module 260 and the extension tube 250 by the suction force generated in the main body 210 of the first cleaner 200.

The dust in the dust bin 220 of the first cleaner 200 may be captured by a dust collecting part 170 of the cleaner station 100 by gravity and a suction force of a dust collecting motor 191. Therefore, it is possible to remove the dust in the dust bin without the user's separate manipulation, thereby providing convenience for the user. In addition, it is possible to eliminate the inconvenience caused because the user needs to empty the dust bin all the time. In addition, it is possible to prevent the dust from scattering when emptying the dust bin.

The first cleaner 200 may be coupled to a lateral surface of a housing 110. Specifically, the main body 210 of the first cleaner 200 may be mounted on a coupling part 120. More specifically, the dust bin 220 and the battery housing 230 of the first cleaner 200 may be coupled to a coupling surface 121, an outer circumferential surface of the dust bin main body 221 may be coupled to a dust bin guide surface 122, and the suction part 212 may be coupled to a suction part guide surface 126 of the coupling part 120. In this case, a center axis of the dust bin 220 may be disposed in a direction parallel to the ground surface, and the extension tube 250 may be disposed along a direction perpendicular to the ground surface (Refer to FIG. 2).

The cleaner system 10 may include the second cleaner 300. The second cleaner 300 may mean a robot cleaner. The second cleaner 300 may automatically clean a zone to be cleaned by sucking foreign substances such as dust from the floor while autonomously traveling in the zone to be cleaned. The second cleaner 300, that is, the robot cleaner may include a distance sensor configured to detect a distance from an obstacle such as furniture, office supplies, or walls installed in the zone to be cleaned, and left and right wheels for moving the robot cleaner. The second cleaner 300 may be coupled to the cleaner station 100. The dust in the second cleaner 300 may be captured into the dust collecting part 170 through a second suction flow path 182.

With reference to FIGS. 1 and 2, the cleaner station 100 of the present disclosure will be described as below.

The first cleaner 200 and the second cleaner 300 may be disposed in the cleaner station 100. The first cleaner 200 may be coupled to the lateral surface of the cleaner station 100. Specifically, a main body of the first cleaner 200 may be coupled to the lateral surface of the cleaner station 100. The second cleaner 200 may be coupled to the lower portion of the cleaner station 100. The cleaner station 100 may remove the dust from the dust bin 220 of the first cleaner 200. The cleaner station 100 may remove the dust from the dust bin (not illustrated) of the second cleaner 300.

The cleaner station 100 may include the housing 110. The housing 110 may define an external appearance of the cleaner station 100. Specifically, the housing 110 may be formed in the form of a column including one or more outer wall surfaces. For example, the housing 110 may be formed in a shape similar to a quadrangular column.

The housing 110 may have a space capable of accommodating the dust collecting part 170 configured to store dust therein, a dust suction module 190 configured to generate a flow force by which the dust is collected into the dust collecting part 170, and a suction flow path 181 through which the dust evacuated from the dust bin 220 flows.

The housing 110 may include a bottom surface 111, an outer wall surface 112, and an upper surface 113.

The bottom surface 311 may support a lower side in a gravitational direction of the dust suction module 190. That is, the bottom surface 311 may support a lower side of the dust collecting motor 191 of the dust suction module 190.

In this case, the bottom surface 111 may be disposed toward the ground surface. The bottom surface 111 may also be disposed in parallel with the ground surface or disposed to be inclined at a predetermined angle with respect to the ground surface. The above-mentioned configuration may be advantageous in stably supporting the dust collecting motor 191 and maintaining the balance of an overall weight even when the cleaner 200 is coupled.

Meanwhile, according to an embodiment, the bottom surface 111 may further include a ground surface support portion 111*a* configured to increase an area in contact with the ground surface so as to prevent the cleaner station 100 from falling and to maintain the balance. For example, the ground surface support portion 111*a* may have a plate shape extending from the bottom surface 111, and one or more frames may protrude and extend from the bottom surface 111 along a direction of the ground surface.

The outer wall surface 112 may mean a surface formed in the gravitational direction or a surface connected to the bottom surface 111. For example, the outer wall surface 112 may mean a surface connected to the bottom surface 111 so as to be perpendicular to the bottom surface 111. In another embodiment, the outer wall surface 112 may be disposed to be inclined at a predetermined angle with respect to the bottom surface 111.

The outer wall surface 112 may include at least one surface. For example, the outer wall surface 112 may include a first outer wall surface 112*a*, a second outer wall surface 112*b*, a third outer wall surface 112*c*, and a fourth outer wall surface 112*d*.

In this case, in the present embodiment, the first outer wall surface 112*a* may be disposed on the front surface of the cleaner station 100. In this case, the front surface may mean a surface on which the cleaner 200 is exposed in a state in which the first cleaner 200 is coupled to the cleaner station 100. Therefore, the first outer wall surface 112*a* may define an external appearance of the front surface of the cleaner station 100.

Meanwhile, the directions are defined as follows to understand the present embodiment. In the present embodiment, the directions may be defined in the state in which the first cleaner 200 is coupled to the cleaner station 100.

In the state in which the first cleaner 200 is coupled to the cleaner station 100, a direction in which the first cleaner 200 is exposed to the outside of the cleaner station 300 may be referred to as a forward direction.

In another point of view, in the state in which the first cleaner 200 is coupled to the cleaner station 100, a direction in which the suction motor 214 of the first cleaner 200 is disposed may be referred to as the forward direction. Further, a direction opposite to the direction in which the suction motor 214 is disposed in the cleaner station 100 may be referred to as a rearward direction.

In still another point of view, a direction in which an intersection point at which the grip portion through line a3 and the suction motor axis a1 intersect is disposed may be referred to as the forward direction on the basis of the cleaner station 100. Alternatively, a direction in which an intersection point P2 at which the grip portion through line a3 and the suction flow path through line a2 intersect is disposed may be referred to as the forward direction. Alternatively, a direction in which an intersection point P1 at which the suction motor axis a1 and the suction motor through line a2 intersect is disposed may be referred to as the forward direction. Further, a direction opposite to the direction in which the intersection points are disposed may be referred to as the rearward direction on the basis of the cleaner station 100.

Further, on the basis of an internal space of the housing 110, a surface facing the front surface may be referred to as a rear surface of the cleaner station 100. Therefore, the rear surface may mean a direction in which the second outer wall surface 112*b* is formed.

Further, on the basis of the internal space of the housing 110, a left surface when viewing the front surface may be referred to as a left surface, and a right surface when viewing the front surface may be referred to as a right surface. Therefore, the left surface may mean a direction in which the third outer wall surface 112*c* is formed, and the right surface may mean a direction in which the fourth outer wall surface 112*d* is formed.

The first outer wall surface 112*a* may be formed in the form of a flat surface, or the first outer wall surface 112*a* may be formed in the form of a curved surface as a whole or formed to partially include a curved surface.

The first outer wall surface 112*a* may have an external appearance corresponding to the shape of the first cleaner 200. In detail, the coupling part 120 may be disposed on the first outer wall surface 112*a*. With this configuration, the first cleaner 200 may be coupled to the cleaner station 100 and supported by the cleaner station 100. The specific configuration of the coupling part 120 will be described below.

Meanwhile, the structure for mounting various types of cleaning modules used for the cleaner 200 may be additionally provided on the first outer wall surface 112*a*.

In addition, a structure to which the second cleaner 300 may be coupled may be additionally provided on the first outer wall surface 112*a*. Therefore, the structure corresponding to the shape of the second cleaner 300 may be additionally provided on the first outer wall surface 112*a*.

Further, a cleaner bottom plate (not illustrated) to which the lower surface of the second cleaner 300 may be coupled may be additionally coupled to the first outer wall surface 112*a*. Meanwhile, in another embodiment, the cleaner bottom plate (not illustrated) may be shaped to be connected to the bottom surface 111.

In the present embodiment, the second outer wall surface 112*b* may be a surface facing the first outer wall surface 112*a*. That is, the second outer wall surface 112*b* may be disposed on the rear surface of the cleaner station 100. In this case, the rear surface may be a surface facing the surface to which the first cleaner 200 or the second cleaner 300 is coupled. Therefore, the second outer wall surface 112*b* may define an external appearance of the rear surface of the cleaner station 100.

For example, the second outer wall surface 112*b* may be formed in the form of a flat surface. With this configuration, the cleaner station 100 may come in close contact with a wall in a room, and the cleaner station 100 may be stably supported.

As another example, the structure for mounting various types of cleaning modules 290 used for the first cleaner 200 may be additionally provided on the second outer wall surface 112*b*.

In addition, the structure to which the second cleaner 300 may be coupled may be additionally provided on the second outer wall surface 112*b*. Therefore, the structure corresponding to the shape of the second cleaner 300 may be additionally provided on the second outer wall surface 112*b*.

Further, a cleaner bottom plate (not illustrated) to which the lower surface of the second cleaner 300 may be coupled may be additionally coupled to the second outer wall surface 112*b*. Meanwhile, as another embodiment, the cleaner bottom plate (not illustrated) may be shaped to be connected to the bottom surface 111. With this configuration, when the second cleaner 300 is coupled to the cleaner bottom plate (not illustrated), an overall center of gravity of the cleaner station 100 may be lowered, so that the cleaner station 100 may be stably supported.

In the present embodiment, the third outer wall surface 112*c* and the fourth outer wall surface 112*d* may mean surfaces that connect the first outer wall surface 112 and the second outer wall surface 112*b*. In this case, the third outer wall surface 112*c* may be disposed on the left surface of the cleaner station 100, and the fourth outer wall surface 112*d* may be disposed on the right surface of the cleaner station 100. Otherwise, the third outer wall surface 112*c* may be disposed on the right surface of the cleaner station 100, and the fourth outer wall surface 112*d* may be disposed on the left surface of the cleaner station 100.

The third outer wall surface 112*c* or the fourth outer wall surface 112*d* may be formed in the form of a flat surface, or the third outer wall surface 112*c* or the fourth outer wall surface 112*d* may be formed in the form of a curved surface as a whole or formed to partially include a curved surface.

Meanwhile, the structure for mounting various types of cleaning modules 290 used for the first cleaner 200 may be additionally provided on the third outer wall surface 112*c* or the fourth outer wall surface 112*d*.

In addition, the structure to which the second cleaner 300 may be coupled may be additionally provided on the third outer wall surface 112*c* or the fourth outer wall surface 112*d*. Therefore, the structure corresponding to the shape of the second cleaner 300 may be additionally provided on the third outer wall surface 112*c* or the fourth outer wall surface 112*d*.

Further, a cleaner bottom plate (not illustrated) to which the lower surface of the second cleaner 300 may be coupled may be additionally provided on the third outer wall surface 112*c* or the fourth outer wall surface 112*d*. Meanwhile, as another embodiment, the cleaner bottom plate (not illustrated) may be shaped to be connected to the bottom surface 111.

The upper surface 113 may form the top appearance of the cleaner station. That is, the upper surface 113 may refer to a surface that is disposed on the uppermost side in the direction of gravity in the cleaner station and exposed to the outside.

For reference, in this embodiment, the upper and lower sides may respectively mean upper and lower sides along a direction of gravity (a direction perpendicular to the ground) in a state where the cleaner station 100 is installed on the ground.

At this time, the upper surface 113 may be disposed parallel to the ground or inclined at a predetermined angle with the ground.

A display unit 410 may be disposed on the upper surface 113. For example, the display unit 410 may display the state of the cleaner station 100 and/or the state of the cleaner 200, and may also display information such as a cleaning progress status and a map of a cleaning area.

Meanwhile, according to the embodiment, the upper surface 113 may be provided detachable from the outer wall surface 112. At this time, when the upper surface 113 is separated, the battery separated from the cleaners 200 and 300 may be accommodated in the internal space surrounded by the outer wall surface 112, and a terminal (not illustrated) capable of charging the separated battery may be provided.

Figure 6:
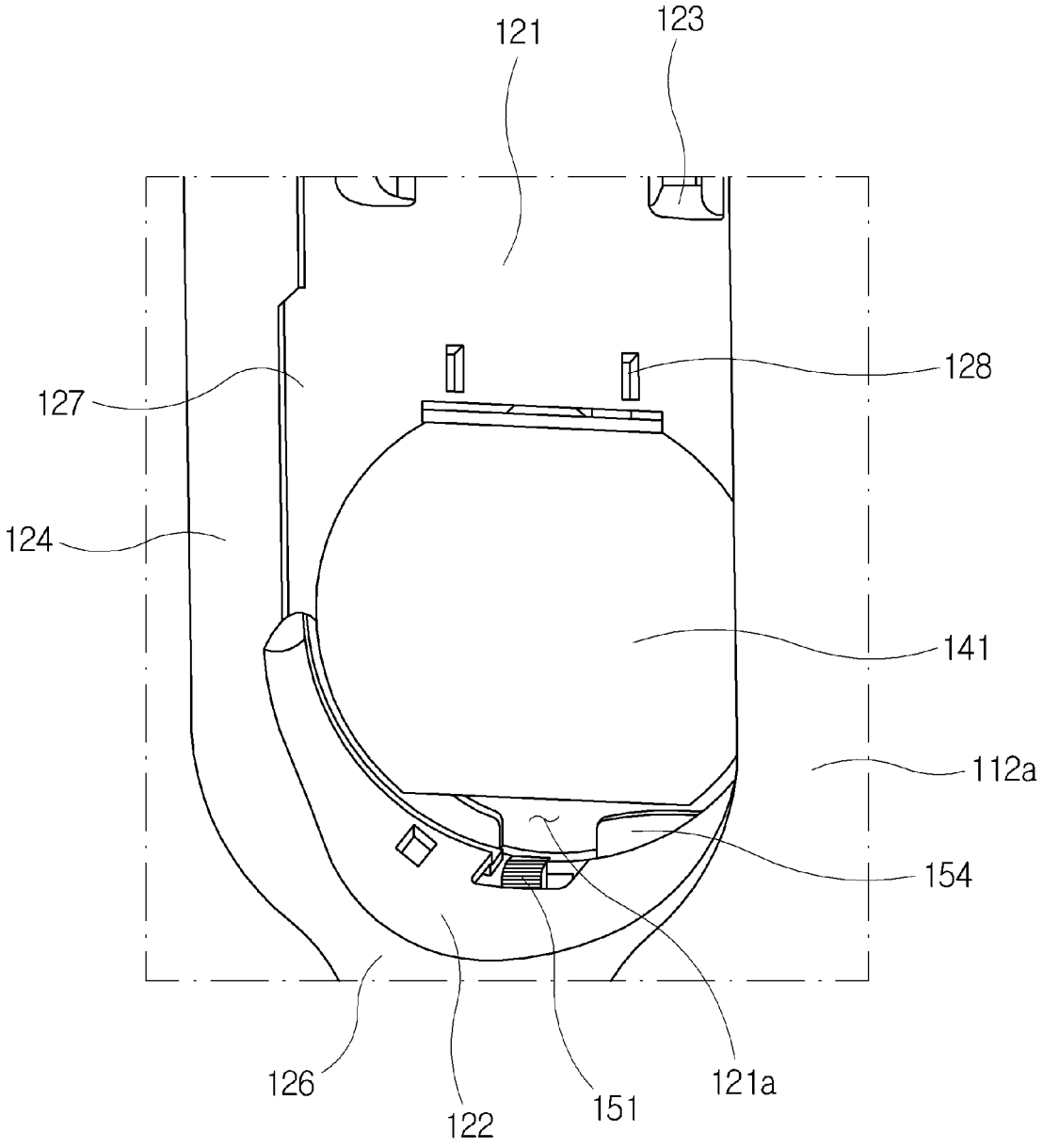
FIG. 6 is a view for describing a coupling part of a cleaner station according to an embodiment of the present disclosure.
Figure 7:
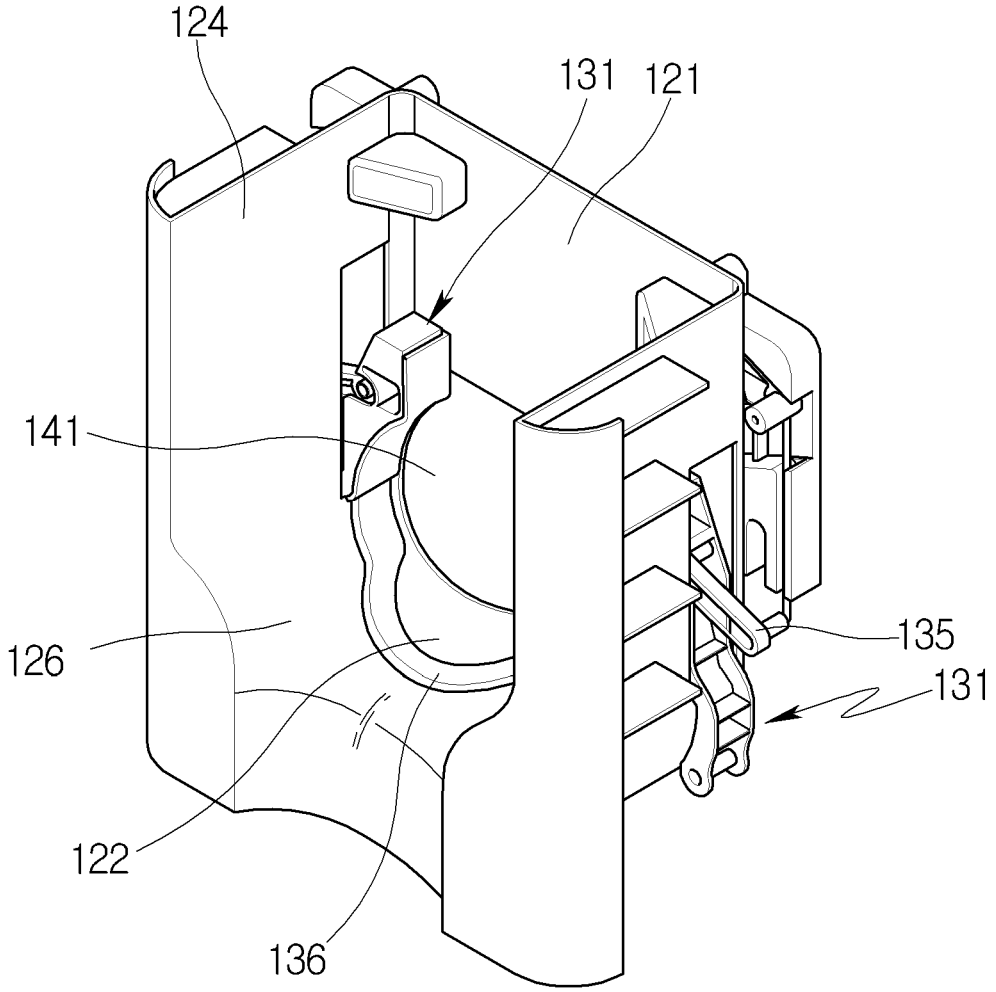
FIG. 7 is an exploded perspective view for describing a fixing unit of a cleaner station according to an embodiment of the present disclosure.
Figure 8:
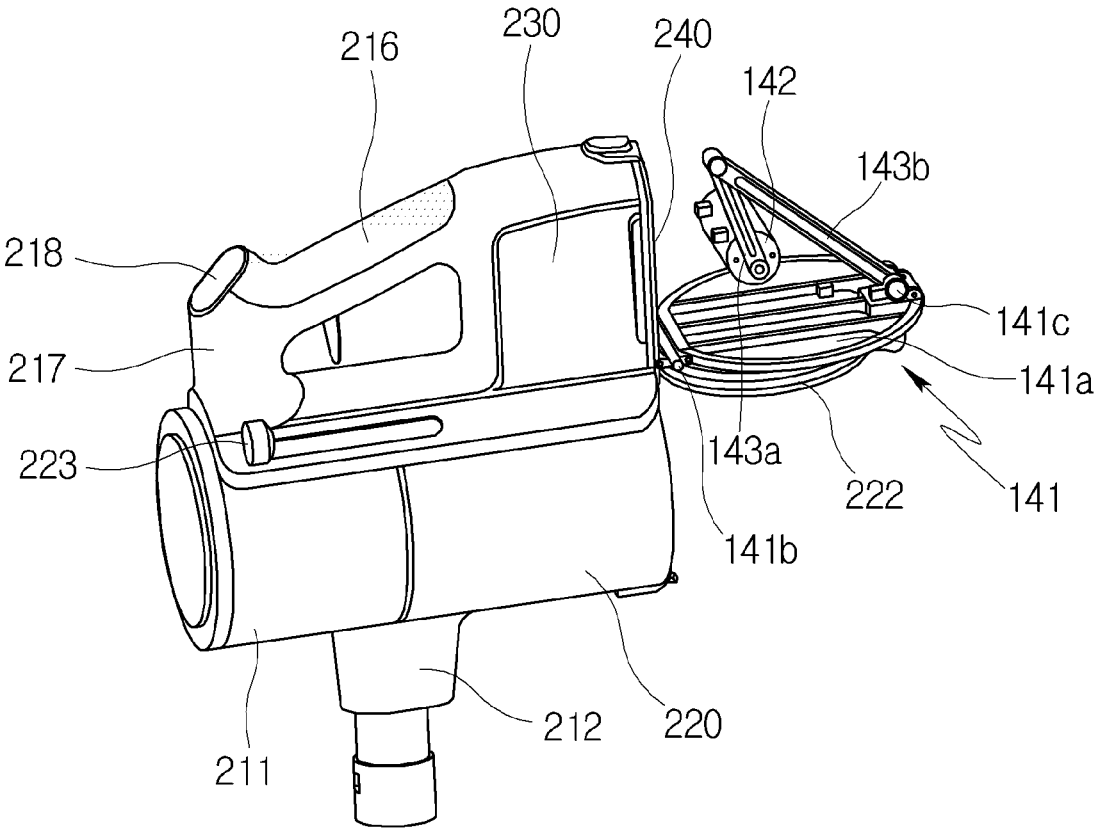
FIG. 8 is a view for describing a relation between a first cleaner and a door unit in a cleaner station according to an embodiment of the present disclosure.
Figure 9:
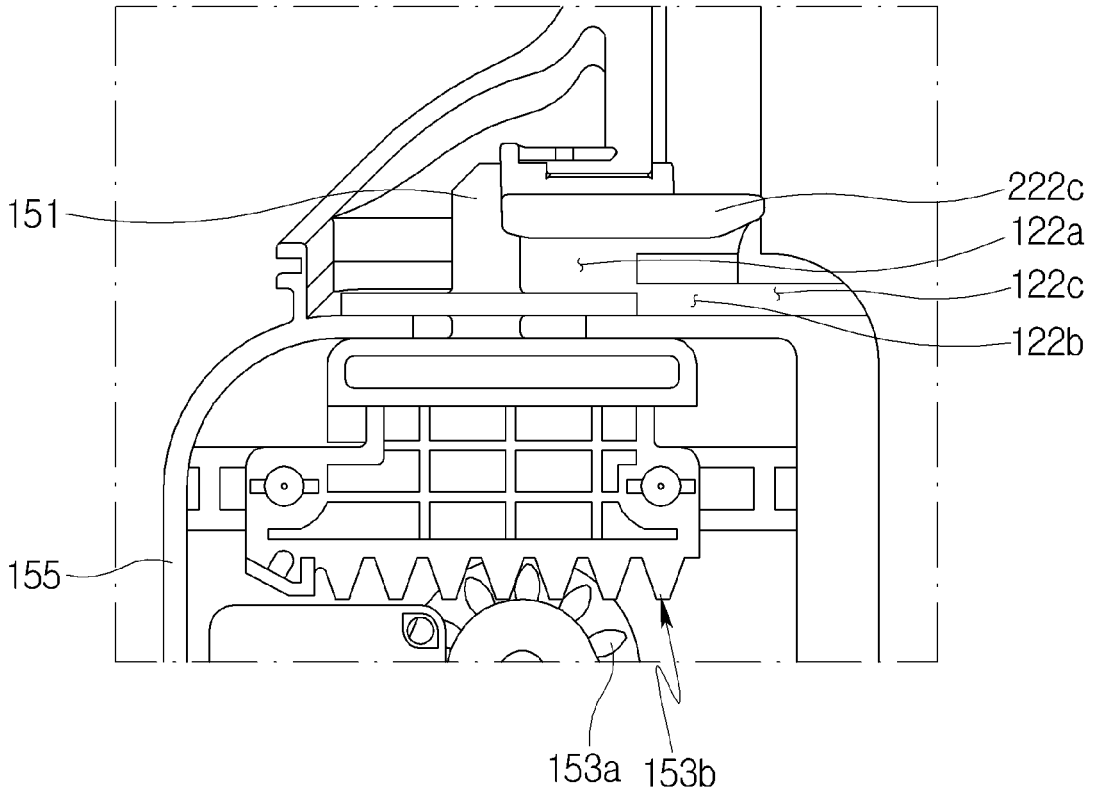
FIG. 9 is a view for describing a relation between a first cleaner and a cover opening unit in a cleaner station according to an embodiment of the present disclosure.

FIG. 6 is a view for describing the coupling part of the cleaner station according to an embodiment of the present disclosure, FIG. 7 is an exploded perspective view for describing a fixing unit of the cleaner station according to an embodiment of the present disclosure, FIG. 8 is a view for describing a relation between the first cleaner and a door unit in the cleaner station according to an embodiment of the present disclosure, and FIG. 9 is a view for describing a relation between the first cleaner and a cover opening unit in the cleaner station according to an embodiment of the present disclosure.

With reference to FIGS. 2 and 6, the coupling part 120 in the cleaner station 100 according to an embodiment of the present disclosure will be described as below.

The cleaner station 100 may include the coupling part 120 on which the first cleaner 200 is mounted to be coupled thereto. Specifically, the coupling part 120 may be disposed in the first outer wall surface 112*a*, and the main body 210, the dust bin 220, and the battery housing 230 of the first cleaner 200 may be coupled to the coupling part 120.

The coupling part 120 may include the coupling surface 121. The coupling surface 121 may be disposed on the lateral surface of the housing 110. For example, the coupling surface 121 may mean a surface formed in the form of a groove which is concave toward the inside of the cleaner station 100 from the first outer wall surface 112*a*. That is, the coupling surface 121 may mean a surface formed to have a stepped portion with respect to the first outer wall surface 112*a*.

The first cleaner 200 may be coupled to the coupling surface 121. For example, the coupling surface 121 may be in contact with the lower surface of the dust bin 220 and the lower surface of the battery housing 230 of the first cleaner 200. In this case, the lower surface may mean a surface directed toward the ground surface when the user uses the first cleaner 200 or places the first cleaner 200 on the ground surface.

For example, an angle of the coupling surface 121 with respect to the ground surface may be a right angle. Therefore, it is possible to minimize a space of the cleaner station 100 when the first cleaner 200 is coupled to the coupling surface 121.

As another example, the coupling surface 121 may be disposed to be inclined at a predetermined angle with respect to the ground surface. Therefore, the cleaner station 100 may be stably supported when the first cleaner 200 is coupled to the coupling surface 121.

The coupling surface 121 may have a dust passage hole 121*a* through which air outside the housing 110 may be introduced into the housing 110. The dust passage hole 121*a* may be formed in the form of a hole corresponding to the shape of the dust bin 220 so that the dust in the dust bin 220 may be introduced into the dust collecting part 170. The dust passage hole 121*a* may be formed to correspond to the shape of the discharge cover 222 of the dust bin 220. The dust passage hole 121*a* may be formed to communicate with a first suction flow path 181 to be described below.

The coupling part 120 may include the dust bin guide surface 122. The dust bin guide surface 122 may be disposed on the first outer wall surface 112*a*. The dust bin guide surface 122 may be connected to the first outer wall surface 112*a*. In addition, the dust bin guide surface 122 may be connected to the coupling surface 121.

The dust bin guide surface 122 may be formed in a shape corresponding to the outer surface of the dust bin 220. A front outer surface of the dust bin 220 may be coupled to the dust bin guide surface 122. Therefore, it is possible to provide convenience when coupling the first cleaner 200 to the coupling surface 121.

Meanwhile, a protrusion moving hole 122*a* may be formed in the dust bin guide surface 122, and a push protrusion 151 to be described below may be rectilinearly moved along the protrusion moving hole 122*a*. In addition, a gear box 155 in which gears and the like of a cover opening unit 150 to be described below, are accommodated may be provided on the lower side of the dust bin guide surface 122 in the direction of gravity. At this time, a guide space 122*b* in which the push protrusion 151 may move may be formed between the lower surface of the dust bin guide surface 122 and the upper surface of the gear box 155. In addition, the guide space 122*b* may communicate with the first suction flow path 181 via a bypass hole 122*c*. That is, the protrusion moving hole 122*a*, the guide space 122*b*, the bypass hole 122*c*, and the first suction flow path 181 may form one flow path. (Refer to FIG. 9) With this configuration, it is advantageous that when the dust collecting motor 191 is operated in a state in which the dust bin 220 is coupled to the coupling part 120, the residual dust and the like remaining in the dust bin 220 and the dust bin guide surface 122 may be sucked through the bypass flow path.

The coupling part 120 may include guide protrusions 123. The guide protrusions 123 may be disposed on the coupling surface 121. The guide protrusions 123 may protrude upward from the coupling surface 121. Two guide protrusions 123 may be disposed to be spaced apart from each other. A distance between the two guide protrusions 123, which are spaced apart from each other, may correspond to a width of the battery housing 230 of the first cleaner 200. With this configuration, convenience may be provided when coupling the first cleaner 200 to the coupling surface 121.

The coupling part 120 may include sidewalls 124. The sidewalls 124 may mean wall surfaces disposed on two lateral surfaces of the coupling surface 121 and may be perpendicularly connected to the coupling surface 121. The sidewalls 124 may be connected to the first outer wall surface 112*a*. In addition, the sidewalls 124 may define surfaces connected to the dust bin guide surface 122. Therefore, the first cleaner 200 may be stably accommodated.

The coupling part 120 may include a coupling sensor. The coupling sensor 125 may detect whether the first cleaner 200 is coupled to the coupling part 120.

The coupling sensor 125 may include a contact sensor. For example, the coupling sensor 125 may include a microswitch. In this case, the coupling sensor 125 may be disposed on the guide protrusion 123. Therefore, when the battery housing 230 or the battery 240 of the first cleaner 200 is coupled between the pair of guide protrusions 123, the battery housing 230 or the battery 240 comes into contact with the coupling sensor 125, such that the coupling sensor 125 may detect that the first cleaner 200 is coupled to the cleaner station 100.

Meanwhile, the coupling sensor 125 may include a non-contact sensor. For example, the coupling sensor 125 may include an infrared (IR) sensor. In this case, the coupling sensor 125 may be disposed on the sidewall 124. Therefore, when the dust bin 220 or the main body 210 of the first cleaner 200 passes the sidewall 124 and then reaches the coupling surface 121, the coupling sensor 125 may detect the presence of the dust bin 220 or the main body 210.

The coupling sensor 125 may face the dust bin 220 or the battery housing 230 of the first cleaner 200.

The coupling sensor 125 may be a means for determining whether the first cleaner 200 is coupled and power is applied to the battery 240 of the first cleaner 200.

The coupling part 120 may include the suction part guide surface 126. The suction part guide surface 126 may be disposed on the first outer wall surface 112*a*. The suction part guide surface 126 may be connected to the dust bin guide surface 122. The suction part 212 may be coupled to the suction part guide surface 126. A shape of the suction part guide surface 126 may correspond to the shape of the suction part 212.

The coupling part 120 may further include fixing member entrance holes 127. The fixing member entrance hole 127 may be formed in the form of a long hole along the sidewall 124 so that a fixing member 131 may enter and exit the fixing member entrance hole 127.

With this configuration, when the user couples the first cleaner 200 to the coupling part 120 of the cleaner station 100, the main body 210 of the first cleaner 200 may be stably disposed on the coupling part 120 by the dust bin guide surface 122, the guide protrusions 123, and the suction part guide surface 126. Therefore, it is possible to provide convenience when coupling the dust bin 220 and the battery housing 230 of the first cleaner 200 to the coupling surface 121.

With reference to FIGS. 2 and 7, a fixing unit 130 according to the present disclosure will be described as below.

The cleaner station 100 according to the present disclosure may include the fixing unit 130. The fixing unit 130 may be disposed on the sidewall 124. In addition, the fixing unit 130 may be disposed on a back surface of the coupling surface 121. The fixing unit 130 may fix the first cleaner 200 coupled to the coupling surface 121. Specifically, the fixing unit 130 may fix the dust bin 220 and the battery housing 230 of the first cleaner 200 coupled to the coupling surface 121.

The fixing unit 130 may include the fixing members 131 configured to fix the dust bin 220 and the battery housing 230 of the first cleaner 200, and a fixing part motor 133 configured to drive the fixing members 131. In addition, the fixing unit 130 may further include a fixing part link 135 configured to transmit power from the fixing part motor 133 to the fixing members 131.

The fixing members 131 may be disposed on the sidewall 124 and provided on the sidewall 124 so as to reciprocate in order to fix the dust bin 220. Specifically, the fixing members 131 may be accommodated in the fixing member entrance holes 127.

The fixing members 131 may be disposed at both sides of the coupling part 120, respectively. For example, a pair of two fixing members 131 may be symmetrically disposed with respect to the coupling surface 121.

The fixing part motor 133 may provide power to move the fixing members 131.

The fixing part link 135 may convert a rotational force of the fixing part motor 133 into a reciprocating movement of the fixing members 131.

A stationary sealer 136 may be disposed on the dust bin guide surface 122 so as to seal the dust bin 220 when the first cleaner 200 is coupled. With this configuration, when the dust bin 220 of the first cleaner 200 is coupled, the first cleaner 200 may press the stationary sealer 136 by its own weight, such that the dust bin 220 and the dust bin guide surface 122 may be sealed.

The stationary sealer 136 may be disposed in an imaginary extension line of the fixing members 131. With this configuration, when the fixing motor 133 operates and the fixing members 131 press the dust bin 220, a circumference of the dust bin 220 at the same height may be sealed.

According to the embodiment, the stationary sealer 136 may be disposed on the dust bin guide surface 122 and formed in the form of a bent line corresponding to an arrangement of the cover opening unit 150 to be described below.

Therefore, when the main body 210 of the first cleaner 200 is disposed on the coupling part 120, the fixing unit 130 may fix the main body 210 of the first cleaner 200. Specifically, when the coupling sensor 125 detects that the main body 210 of the first cleaner 200 is coupled to the coupling part 120 of the cleaner station 100, the fixing part motor 133 may move the fixing members 131 to fix the main body 210 of the first cleaner 200.

Therefore, it is possible to improve the suction force of the cleaner by preventing the residual dust from remaining in the dust bin 220. Further, it is possible to remove an offensive odor caused by the residual dust by preventing the residual dust from remaining in the dust bin.

With reference to FIGS. 2 and 8, a door unit 140 of the present disclosure will be described as below.

The cleaner station 100 according to the present disclosure may include the door unit 140. The door unit 140 may be configured to open or close the dust passage hole 121*a*.

The door unit 140 may include a door 141, a door motor 142, and a door arm 143.

The door 141 may be disposed in the coupling part 120, may be hingedly coupled to the coupling surface 121 and may open or close the dust passage hole 121*a* formed on one end of the first suction flow path 181. The door 141 may include a door main body 141*a*, a hinge part 141*b*, and an arm coupling part 141*c*.

The door main body 141*a* may be formed in a shape capable of blocking the dust passage hole 121*a*. For example, the door main body 141*a* may be formed in a shape similar to a circular plate shape. On the basis of a state in which the door main body 341*a* blocks the dust passage hole 121*a*, the hinge part 141*b* may be disposed at an upper side of the door main body 141*a*, and the arm coupling part 141*c* may be disposed at a lower side of the door main body 141*a*.

The door main body 141*a* may be formed in a shape capable of sealing the dust passage hole 121*a*. For example, an outer surface of the door main body 141*a*, which is exposed to the outside of the cleaner station 100, is formed to have a diameter corresponding to a diameter of the dust passage hole 121*a*, and an inner surface of the door main body 141*a*, which is disposed inside the cleaner station 100, is formed to have a diameter greater than the diameter of the dust passage hole 121*a*. In addition, a level difference may be defined between the outer surface and the inner surface. Meanwhile, one or more reinforcing ribs may protrude from the inner surface in order to connect the hinge part 141*b* and the arm coupling part 141*c* and reinforce a supporting force of the door main body 141*a*.

The hinge part 141*b* may be a means by which the door 141 is hingedly coupled to the coupling surface 121. The hinge part 141*b* may be disposed at an upper end of the door main body 141*a* and may be coupled to the coupling surface 121.

The arm coupling part 141*c* may be a means to which the door arm 143 is rotatably coupled. The arm coupling part 141*c* may be disposed at a lower side of the inner surface, and the door arm 143 may be rotatably coupled to the arm coupling part 141*c*.

With this configuration, when the door arm 143 pulls the door main body 141*a* in the state in which the door 141 closes the dust passage hole 121*a*, the door main body 141*a* is rotated about the hinge part 141*b* toward the inside of the cleaner station 100, such that the dust passage hole 121*a* may be opened. Meanwhile, when the door arm 143 pushes the door main body 141*a* in the state in which the dust passage hole 121*a* is opened, the door main body 141*a* is rotated about the hinge part 141*b* toward the outside of the cleaner station 100, such that the dust passage hole 121*a* may be closed.

The door motor 142 may provide power for rotating the door 141. Specifically, the door motor 142 may rotate the door arm 143 in a forward direction or a reverse direction. In this case, the forward direction may mean a direction in which the door arm 143 pulls the door 141. Therefore, when the door arm 143 is rotated in the forward direction, the dust passage hole 121*a* may be opened. In addition, the reverse direction may mean a direction in which the door arm 143 pushes the door 141. Therefore, when the door arm 143 is rotated in the reverse direction, at least a part of the dust passage hole 121*a* may be closed. The forward direction may be opposite to the reverse direction.

The door arm 143 may connect the door 141 and the door motor 142 and open or close the door 141 using the power generated from the door motor 142.

For example, the door arm 143 may include a first door arm 143*a* and a second door arm 143*b*. One end of the first door arm 143*a* may be coupled to the door motor 142. The first door arm 143*a* may be rotated by the power of the door motor 142. The other end of the first door arm 143*a* may be rotatably coupled to the second door arm 143*b*. The first door arm 143*a* may transmit a force transmitted from the door motor 142 to the second door arm 143*b*. One end of the second door arm 143*b* may be coupled to the first door arm 143*a*. The other end of the second door arm 143*b* may be coupled to the door 141. The second door arm 143*b* may open or close the dust passage hole 121*a* by pushing or pulling the door 141.

Meanwhile, the first door arm 143*a* and the door motor 142 may be directly coupled as illustrated in an embodiment of FIG. 8, or the first door arm 143*a* and the door motor 142 may be coupled through at least one or more gear parts so that a direction and velocity of a rotational force provided by the drive of the door motor 142 can be adjusted. (Refer to FIG. 15) The door unit 140 may further include door opening/closing detecting parts 144. The door opening/closing detecting parts 144 may be provided in the housing 100, and may detect whether the door 141 is in an opened state.

For example, the door opening/closing detecting parts 144 may be disposed at both ends in a rotational region of the door arm 143, respectively. In another example, the door opening/closing detecting parts 144 may be disposed at both ends in a movement region of the door 141, respectively.

Therefore, when the door arm 143 is moved to a predetermined door opening position (DP1), or the door 141 is opened to a certain position, the door opening/closing detecting part 144 may detect that the door is opened. In addition, when the door arm 143 is moved to a predetermined door closing position (DP2), or the door 141 is opened to a certain position, the door opening/closing detecting part 144 may detect that the door is opened. In addition, in the present embodiment, when the door arm 143 is moved to a predetermined door air flow velocity controlling position (DP3), or the door 141 is rotated to a certain position, the door opening/closing detecting part 144 may detect that the dust collecting motor 191 has reached a position capable of changing a velocity of the air flow sucked by the dust collecting motor 191.

The door opening/closing detecting part 144 may include a contact sensor. For example, the door opening/closing detecting part 144 may include a micro-switch.

Meanwhile, the door opening/closing detecting part 144 may also include a non-contact sensor. For example, the door opening/closing detecting part 144 may include an infrared (IR) sensor.

With this configuration, the door unit 140 may selectively open or close at least a part of the coupling surface 121, thereby allowing the outside of the first outer wall surface 112*a* to communicate with the first suction flow path 181 and/or the dust collecting part 170.

The door unit 140 may be opened when the discharge cover 222 of the first cleaner 200 is opened. In addition, when the door unit 140 is closed, the discharge cover 222 of the first cleaner 200 may also be closed.

When the dust in the dust bin 220 of the first cleaner 200 is removed, the door motor 142 may rotate the door 141, thereby coupling the discharge cover 222 to the dust bin main body 221. Specifically, the door motor 142 may rotate the door 141 to rotate the door 142 about the hinge part 141*b*, and the door 142 rotated about the hinge part 141*b* may push the discharge cover 222 toward the dust bin main body 221.

The cover opening unit 150 according to the present disclosure will be described below with reference to FIGS. 2 and 9.

The cleaner station 100 according to the present disclosure may include the cover opening unit 150. The cover opening unit 150 may be disposed on the coupling part 120 and may open the discharge cover 222 of the first cleaner 200.

The cover opening unit 150 may include a push protrusion 151, a cover opening motor 152, cover opening gears 153, a support plate 154, and a gear box 155.

The push protrusion 151 may move to press the coupling lever 222*c* when the first cleaner 200 is coupled.

The push protrusion 151 may be disposed on the dust bin guide surface 122. Specifically, a protrusion moving hole may be formed in the dust bin guide surface 122, and the push protrusion 151 may be exposed to the outside by passing through the protrusion moving hole.

When the first cleaner 100 is coupled, the push protrusion 151 may be disposed at a position at which the push protrusion 151 may push the coupling lever 222*c*. That is, the coupling lever 222*c* may be disposed on the protrusion moving hole. In addition, the coupling lever 222*c* may be disposed in a movement region of the push protrusion 151.

The push protrusion 151 may rectilinearly reciprocate to press the coupling lever 222*c*. Specifically, the push protrusion 151 may be coupled to the gear box 155, such that the rectilinear movement of the push protrusion 151 may be guided. The push protrusion 151 may be coupled to the cover opening gears 153 and moved together with the cover opening gears 153 by the movements of the cover opening gears 153.

The cover opening motor 152 may provide power for moving the push protrusion 151. Specifically, the cover opening motor 152 may rotate a motor shaft (not illustrated) in a forward direction or a reverse direction. In this case, the forward direction may mean a direction in which the push protrusion 151 pushes the coupling lever 222*c*. In addition, the reverse direction may mean a direction in which the push protrusion 151, which has pushed the coupling lever 222*c*, returns back to an original position. The forward direction may be opposite to the reverse direction.

The cover opening gears 153 may be coupled to the cover opening motor 152 and may move the push protrusion 151 using the power from the cover opening motor 152. Specifically, the cover opening gears 153 may be accommodated in the gear box 155. A driving gear 153*a* of the cover opening gears 153 may be coupled to the motor shaft of the cover opening motor 152 and supplied with the power. A driven gear 153*b* of the cover opening gears 153 may be coupled to the push protrusion 151 to move the push protrusion 151. For example, the driven gear 153*b* may be provided in the form of a rack gear, may be engaged with the driving gear 153*a* and may be supplied with the power from the driving gear 153*a*.

At this time, a torsion spring 222*d* may be provided in the discharge cover 222. The discharge cover 222 may be rotated above a certain angle by the elastic force of the torsion spring 222*d*, and supported at the rotated position. Therefore, the discharge cover 222 may be opened, thereby communicating the dust passage hole 121*a* with an inside of the dust bin 220.

The gear box 155 may be provided in the housing 110 and disposed at the lower side of the coupling part 120 in the gravitational direction, and the cover opening gears 153 may be accommodated in the gear box 155.

A cover opening detecting part 155*f* may be disposed in the gear box 155. The cover opening detecting part 155*f* may include a contact sensor. For example, the cover opening detecting part 155*f* may include a micro-switch. Meanwhile, the cover opening detecting part 155*f* may also include a non-contact sensor. For example, the cover opening detecting part 155*f* may include an infrared (IR) sensor.

At least one cover opening detecting part 155*f* may be disposed on an inner surface or an outer surface of the gear box 155. For example, one cover opening detecting part 155*f* may be disposed on the inner surface of the gear box 155. At this time, the cover opening detecting part 155*f* may detect that the push protrusion 151 has returned to the original position.

In another example, two cover opening detecting parts 155*f* may be disposed on the outer surface of the gear box 155. At this time, the cover opening detecting parts 155*f* may detect the original position of the push protrusion 151 and the cover opening position.

Therefore, according to the present disclosure, the convenience may be improved since the dust bin 220 may be opened without the user's separate manipulation for opening the discharge cover 222.

In addition, since the discharge cover 222 is opened in a state in which the first cleaner 200 is coupled to the cleaner station 100, there is an effect of preventing dust from scattering.

Meanwhile, the dust collecting part 170 will be described below with reference to FIG. 2.

The cleaner station 100 may include the dust collecting part 170. The dust collecting part 170 may be disposed in the housing 110. The dust collecting part 170 may be disposed at a lower side in the gravitational direction of the coupling part 120.

For example, the dust collecting part 170 may mean a dust bag configured to collect dust sucked from the inside of the dust bin 220 of the first cleaner 200 by the dust collecting motor 191.

The dust collecting part 170 may be removably coupled to the housing 110.

Therefore, the dust collecting part 170 may be separated from the housing 110 to be discarded, and a new dust collecting part 170 may be coupled to the housing 110. That is, the dust collecting part 170 may be defined as a consumable part.

The dust bag may be provided such that a volume thereof increases when the suction force is generated by the dust collecting motor 200 to accommodate dust in the dust bag. To this end, the dust bag may be formed of a material that allows the air to penetrate, but does not allow foreign substances such as dust to penetrate. For example, the dust bag may be formed of a non-woven fabric material, and may have a hexahedral shape on the basis of a state when the volume thereof increases.

Therefore, the convenience of the user may be improved since there is no need to additionally tie up the dust bag in which dust is captured.

Meanwhile, the cleaner station 100 may further include a sterilization module 175.

The sterilization module 175 may be provided on the flow path part 180, or may be provided by at least one in number around the dust collecting part 170.

The sterilization module 175 is configured to sterilize the dust captured in the dust collecting part 170. The sterilization module 175 may include a light source configured to emit the sterilization light, and a protection panel disposed below the light source and configured to protect the light source.

In this case, the light source may include one or more light-emitting diodes (LEDs) capable of emitting the sterilization light having sterilizing power for removing bacteria. The sterilization light emitted from the light source may have a wavelength that varies depending on types of light-emitting diodes.

For example, the light source may be a light-emitting diode that emits ultraviolet rays within UV-C wavelength ranges. The ultraviolet rays are divided into UV-A rays (315 nm to 400 nm), UV-B rays (280 nm to 315 nm), and UV-C rays (200 nm to 280 nm) based on the wavelengths. The ultraviolet ray in the UV-C region may inhibit the proliferation of microorganisms by damaging DNA double helices of the microorganisms.

Alternatively, as another example, the light source may be a light-emitting diode that emits visible light with a wavelength of 405 nm. The blue light having a wavelength of 405 nm has a wavelength in a boundary region between the visible ray and the ultraviolet ray and the sterilizing power thereof has been proved.

To prevent damage to the light source, the protection panel may be disposed below the light source and spaced apart from the light source at a predetermined distance. In this case, the protection panel may be made of a material that maximizes the transmittance of the light source. For example, the protection panel may be made of quartz. It is known that the quartz does not hinder the transmission of the ultraviolet rays in the UV-C region.

The cleaner station 100 according to the embodiments of the present disclosure includes the sterilization module 175 configured to provide sterilization so as to inhibit the proliferation of microorganisms in the dust collecting part 170, and therefore, may hygienically manage the dust collecting part 170 which stores the sucked dust for a longer period of time.

Meanwhile, the flow path part 180 will be described below with reference to FIGS. 2 and 10.

The cleaner station 100 may include the flow path part 180. The flow path part 180 may connect the first cleaner 200 or the second cleaner 300 to the dust collecting part 170.

The flow path part 180 may include the first suction flow path 181, the second suction flow path 182, and a flow path switching valve 183.

The first suction flow path 181 may connect the dust bin 220 of the first cleaner 200 to the dust collecting part 170. The first suction flow path 181 may be disposed at a rear side of the coupling surface 121. The first suction flow path 181 may mean a space between the dust bin 220 of the first cleaner 200 and the dust collecting part 170. The first suction flow path 181 may be a space formed at a rear side of the dust passage hole 121*a*. The first suction flow path 181 may be bent downward from the dust passage hole 121*a*, and may be a suction flow path which allows the dust and the air evacuated from the dust bin 220 to flow therethrough.

The dust in the dust bin 220 of the first cleaner 200 may move to the dust collecting part 170 through the first suction flow path 181.

The second suction flow path 182 may connect the second cleaner 300 to the dust collecting part 170. The dust in the second cleaner 300 may move to the dust collecting part 170 through the second suction flow path 182.

The flow path switching valve 183 may be disposed between the dust collecting part 170, and the first and the second suction flow paths 181 and 182. The flow path switching valve 183 may selectively open or close the first suction flow path 181 and the second suction flow path 182 connected to the dust collecting part 170. Therefore, it is possible to prevent a decrease in the suction force caused when the plurality of flow paths 181 and 182 is opened.

For example, in a case in which only the first cleaner 200 is coupled to the cleaner station 100, the flow path switching valve 183 may connect the first suction flow path 181 to the dust collecting part 170 and disconnect the second suction flow path 182 from the dust collecting part 170.

Meanwhile, the dust suction module 190 will be described below with reference to FIGS. 2 and 10.

The cleaner station 100 may include the dust suction module 190. The dust suction module 190 may include the dust collecting motor 191, a first filter 192, and a second filter (not illustrated).

The dust collecting motor 191 may be disposed in the internal space of the housing 110. In addition, the dust collecting motor 191 may be disposed below the dust collecting part 170. Further, the dust collecting motor 191 may be disposed below the first suction flow path 181. The dust collecting motor 191 may generate the suction force in the first suction flow path 181 and the second suction flow path 182. Therefore, the dust collecting motor 191 may provide the suction force capable of sucking the dust in the dust bin 220 of the first cleaner 200 and the dust in the dust bin of the second cleaner 300.

The dust collecting motor 191 may generate the suction force by means of the rotation. For example, the dust collecting motor 191 may be formed in a shape similar to a cylinder.

Meanwhile, in the present embodiment, an imaginary suction motor axis C which extends a rotational axis of the dust collecting motor 191 may be formed.

The first filter 192 may be disposed between the dust collecting part 170 and the dust collecting motor 191. The first filter 192 may be a prefilter. (Refer to FIG. 2)

The second filter (not illustrated) may be disposed between the dust collecting motor 191 and the outer wall surface 112. The second filter (not illustrated) may be an HEPA filter.

Meanwhile, the cleaner station 100 may further include a charging terminal 128. The charging terminal 128 may be disposed in the coupling part 120. The charging terminal 128 may be electrically connected to the first cleaner 200 that is coupled to the coupling part 120. More specifically, the charging terminal 128 may be electrically coupled to the battery terminal 270 of the first cleaner 200 so as to supply power to the battery 240 of the first cleaner 200 that is coupled to the coupling part 120.

In addition, the charging terminal 128 may include a lower charging terminal (not illustrated) disposed in a lower region of the housing 110. The lower charging terminal may be electrically connected to the second cleaner 300 that is coupled to the lower region of the housing 110. The lower charging terminal may supply power to the battery of the second cleaner 300 that is coupled to the lower region of the housing 110.

In addition, the cleaner station 100 may include a lateral door (not illustrated). The lateral door may be disposed in the housing 110. The lateral door may selectively expose the dust collecting part 170 to the outside. Therefore, the user may easily remove the dust collecting part 170 from the cleaner station 100.

Meanwhile, with reference to FIGS. 2 and 3, a state in which the first cleaner 200 is coupled to the cleaner station 100 will be described as below.

In the present disclosure, the first cleaner 200 may be mounted on the outer wall surface 112 of the cleaner station 100. For example, the dust bin 220 and battery housing 230 of the first cleaner 200 may be coupled to the coupling surface 121 of the cleaner station 100. That is, the first cleaner 200 may be mounted on the first outer wall surface 112*a*.

In this case, the suction motor axis a1 may be defined perpendicular to the first outer wall surface 112*a*. That is, the suction motor axis a1 may be defined in parallel with the ground surface. The suction motor axis a1 may be defined on a plane perpendicular to the ground surface. In addition, the suction motor axis a1 may be defined on a plane that perpendicularly intersects the first outer wall surface 112*a*.

The suction flow path through line a2 may be defined in parallel with the first outer wall surface 112*a*. The suction flow path through line a2 may be defined in the gravitational direction. That is, the suction flow path through line a2 may be defined to be perpendicular to the ground surface. In addition, the suction flow path through line a2 may be defined on the plane that perpendicularly intersects the first outer wall surface 112*a*.

The grip portion through line a3 may be defined to be inclined at a predetermined angle with respect to the first outer wall surface 112*a*. In addition, the grip portion through line a3 may be defined to be inclined at a predetermined angle with respect to the ground surface. The grip portion through line a3 may be defined on the plane that perpendicularly intersects the first outer wall surface 112*a*.

The cyclone line a4 may be defined to be perpendicular to the first outer wall surface 112*a*. That is, the cyclone line a4 may be defined in parallel with the ground surface. The cyclone line a4 may be defined on the plane perpendicular to the ground surface. In addition, the cyclone line a4 may be defined on the plane that perpendicularly intersects the first outer wall surface 112*a*.

The dust bin through line a5 may be defined to be perpendicular to the first outer wall surface 112*a*. That is, the dust bin through line a5 may be defined in parallel with the ground surface. The dust bin through line a5 may be defined on the plane perpendicular to the ground surface. In addition, the dust bin through line a5 may be defined on the plane that perpendicularly intersects the first outer wall surface 112*a*.

The dust collecting motor axis C may be defined to be perpendicular to the ground surface. The dust collecting motor axis C may be defined in parallel with at least any one of the first outer wall surface 112*a*, the second outer wall surface 112*b*, the third outer wall surface 112*c*, and the fourth outer wall surface 112*d*.

When the first cleaner 200 is coupled to the cleaner station 100, the suction motor axis a1 may intersect a longitudinal axis of the cleaner station 100. That is, the rotational axis of the suction motor 214 may intersect the longitudinal axis of the cleaner station 100.

When the first cleaner 200 is coupled to the cleaner station 100, the suction motor axis a1 may intersect the dust collecting motor axis C.

In the state in which the first cleaner 200 and the cleaner station 100 are coupled, the suction motor axis a1 may intersect the dust collecting motor axis C at a predetermined angle. For example, an included angle θ1 between the suction motor axis a1 and the dust collecting motor axis C may be 40 degrees or more and 95 degrees or less.

In this case, the included angle may mean an angle defined as the suction motor axis a1 and the dust collecting motor axis C intersect each other, that is, an included angle defined between the suction motor axis a1 and the dust collecting motor axis C.

Meanwhile, when the first cleaner 200 is coupled to the cleaner station 100, the handle 216 may be disposed to be farther from the ground surface than is the suction motor axis a1. With this configuration, when the user grasps the handle 216, the relatively heavy suction motor 214 is positioned at the lower side in the gravitational direction, and the user may couple or separate the first cleaner 200 to/from the cleaner station 100 only by simply moving the first cleaner 200 in the direction parallel to the ground surface. As a result, it is possible to provide convenience for the user.

In addition, when the first cleaner 200 is coupled to the cleaner station 100, the battery 240 may be disposed to be farther from the ground surface than is the suction motor axis a1. With this configuration, the first cleaner 200 may be stably supported on the cleaner station 100.

When the first cleaner 200 is coupled to the cleaner station 100, the suction flow path through line a2 may be defined in parallel with the dust collecting motor axis C. With this configuration, it is possible to minimize an occupied space on a horizontal plane in the state in which the first cleaner 200 is coupled to the cleaner station 100.

In this case, the coupling part 120 may be disposed between the suction flow path through line a2 and the dust collecting motor axis C. The fixing member 131 may be disposed between the suction flow path through line a2 and the dust collecting motor axis C. The cover opening unit 150 may be disposed between the suction flow path through line a2 and the dust collecting motor axis C. With this configuration, the user may couple or separate the first cleaner 200 to/from the cleaner station 100, fix the dust bin 220, and open the dust bin 220 only by simply moving the first cleaner 200 in the direction parallel to the ground surface. As a result, it is possible to provide convenience for the user.

The grip portion through line a3 may intersect the dust collecting motor axis C at a predetermined angle. In this case, an intersection point P6 between the grip portion through line a3 and the dust collecting motor axis C may be positioned in the housing 110. This configuration is advantageous in that the user may couple the first cleaner 200 to the cleaner station 100 only by simply pushing his/her arm toward the lateral side of the cleaner station 100 in the state in which the user grasps the first cleaner 200. In addition, since the dust collecting motor 191, which is relatively heavy in weight, is accommodated in the housing 110, it is possible to prevent the cleaner station 100 from swaying even though the user strongly pushes the first cleaner 200 into the cleaner station 100.

When the first cleaner 200 is coupled to the cleaner station 100, the cyclone line a4 may intersect the longitudinal axis of the cleaner station 100. That is, a flow axis of the dust separating part 213 may intersect the longitudinal axis of the cleaner station 100. In this case, the intersection point between the flow axis of the dust separating part 213 and the longitudinal axis of the cleaner station 100 may be positioned in the housing 110, and more particularly, positioned in the flow path part 180.

When the first cleaner 200 is coupled to the cleaner station 100, the cyclone line a4 may intersect the dust collecting motor axis C. In this case, the intersection point between the cyclone line a4 and the dust collecting motor axis C may be positioned in the housing 110, and more particularly, positioned in the flow path part 180. With this configuration, the first cleaner 200 may be stably supported on the cleaner station 100 in the state in which the first cleaner 200 is coupled to the cleaner station 100, and a loss of a flow path may be reduced during the operation of emptying the dust bin 220.

When the first cleaner 200 is coupled to the cleaner station 100, the dust bin through line a5 may intersect the longitudinal axis of the cleaner station 100. That is, the longitudinal axis of the dust bin 220 may intersect the longitudinal axis of the cleaner station 100. In this case, an intersection point between the longitudinal axis of the dust bin 220 and the longitudinal axis of the cleaner station 100 may be positioned in the housing 110, and more particularly, positioned in the flow path part 180.

Meanwhile, when the first cleaner 200 is coupled to the cleaner station 100, the handle 216 may be disposed to be farther from the ground surface than is the dust bin through line a5. With this configuration, when the user grasps the handle 216, the user may couple or separate the first cleaner 200 to/from the cleaner station 100 only by simply moving the first cleaner 200 in the direction parallel to the ground surface. As a result, it is possible to provide convenience for the user.

In addition, when the first cleaner 200 is coupled to the cleaner station 100, the battery 240 may be disposed to be farther from the ground surface than is the dust bin through line a5. With this configuration, because the battery 240 pushes the main body 210 of the first cleaner 200 by means of the weight of the battery 240, the first cleaner 200 may be stably supported on the cleaner station 100.

Hereinafter, a method for controlling the cleaner system which is a preferred embodiment of the present disclosure will be described. First, a block diagram of a configuration related to the method for controlling the cleaner system will be described and the method for controlling the cleaner system will be described later.

Meanwhile, a component referred to as the cleaner in the present disclosure is a cleaner which allows the user to grip the handle so as to operate the cleaning operation manually, and the cleaner may be understood as the first cleaner 200 described with reference to FIGS. 1 to 9.

Figure 10:
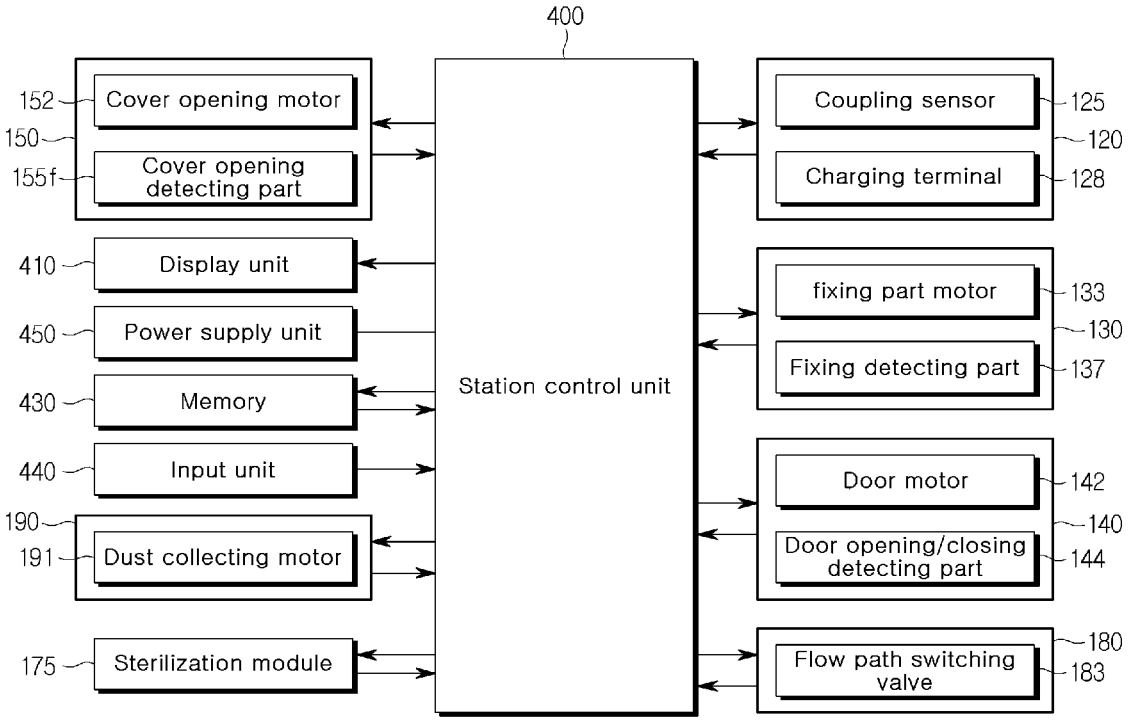
FIG. 10 is a block diagram of a cleaner station included in a cleaner system according to an embodiment of the present disclosure.
Figure 11:
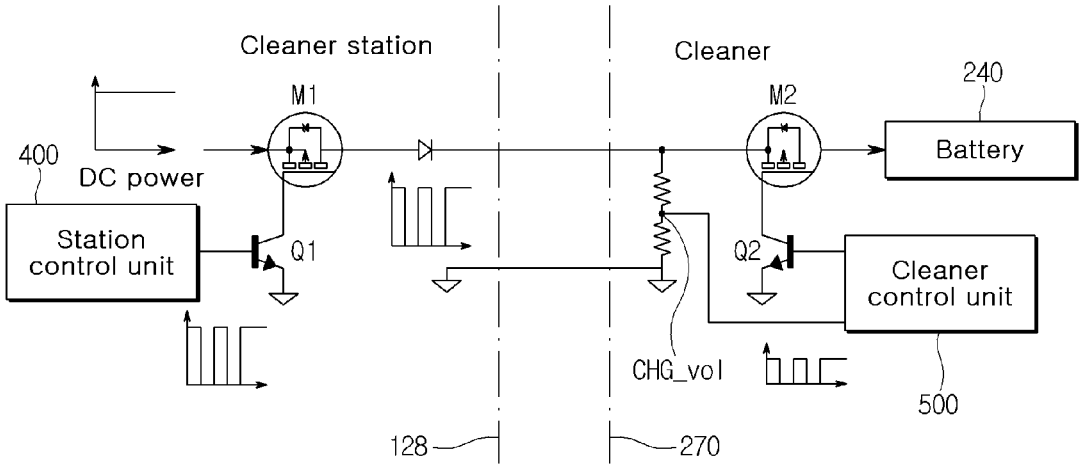
FIG. 11 is a circuit diagram illustrating a configuration for communication through a power line between a cleaner station and a cleaner.

FIG. 10 is a block diagram of the cleaner station included in the cleaner system according to an embodiment of the present disclosure, and FIG. 11 is a circuit diagram illustrating a configuration for communication through a power line between the cleaner station and the cleaner.

With reference to FIG. 10, a control configuration of the cleaner station 100 of the present disclosure will be described as below.

The cleaner station 100 according to the embodiment of the present disclosure may further include a station control unit 400 configured to control the coupling part 120, the fixing unit 130, the door unit 140, the cover opening unit 150, the dust collecting part 170, the flow path part 180, and the dust suction module 190.

The station control unit 400 may include a printed circuit board, and elements mounted on the printed circuit board.

When the coupling sensor 125 detects the coupling of the first cleaner 200, the coupling sensor 125 may transmit a signal indicating that the first cleaner 200 is coupled to the coupling part 120. In this case, the station control unit 400 may receive the signal from the coupling sensor 125 and determine that the first cleaner 200 is coupled to the coupling part 120.

In addition, when the charging terminal 128 supplies power to the battery 240 of the first cleaner 200, the station control unit 400 may determine that the first cleaner 200 is coupled to the coupling part 120.

The cleaner station 100 of the present disclosure may further include a power supply unit 450. The power supply unit 450 may be disposed in the internal space of the housing 110. The power supply unit 450 may include a converter circuit configured to convert a rated AC power supplied from the outside into a DC power having a proper magnitude. The power supply unit 450 may be connected to the charging terminal 128, and the DC power converted through the charging terminal 129 may be provided to the first cleaner 200. The power supply unit 450 may include at least one or more switching elements configured to control turning on or off of the application of the DC power to be supplied to the first cleaner 200. When the switching element is turned on, a voltage is supplied to the first cleaner 200, and when the switching element is turned off, the voltage application to the first cleaner 200 is blocked.

Meanwhile, when the station control unit 400 determines that the first cleaner 200 is coupled to the cleaner station 100, the station control unit 400 may control the power supply unit 450 to apply a pulse signal to the cleaner 200 through the charging terminal 128 which is electrically connected to the battery terminal 270 of the first cleaner 200. More specifically, the pulse signal is a signal which is generated by turning on or off the charging voltage supplied to the first cleaner 200 from the power supply unit 450 so as to charge the first cleaner 200 at a predetermined interval a predetermined number of times, and the station control unit 450 may control the switching element so as to control turning on or off of the application of the charging voltage.

More specifically, with reference to the circuit diagram of FIG. 11, the switching element may be configured with a transistor Q1 and a mosfet M1, the mosfet M1 may be disposed between the input terminal of the AC power and the first cleaner 200, and the transistor Q1 may be connected to a gate of the mosfet M1. In this case, according to turning on or off of the transistor Q1, the turning on or off of the mosfet M1 may be controlled. The station control unit 400 is connected to a base terminal of the transistor Q1 and controls turning on or off of the transistor Q1 so that the turning on or off of the mosfet M1 may be finally controlled, and the pulse signal allowing application and blocking of the charging voltage may be generated and supplied to the first cleaner 200.

When the station control unit 400 determines that the first cleaner 200 is coupled to the coupling part 120, the station control unit 400 may operate the fixing part motor 133 so as to fix the first cleaner 200.

When the fixing members 131 or the fixing part links 135 are moved to a predetermined fixing point FP1, a fixing detecting part 137 may transmit a signal indicating that the first cleaner 200 is fixed. The station control unit 400 may receive the signal, which indicates that the first cleaner 200 is fixed, from the fixing detecting part 137 and determine that the first cleaner 200 is fixed. When the station control unit 400 determines that the first cleaner 200 is fixed, the control unit 400 may stop the operation of the fixing part motor 133.

Meanwhile, when the operation of emptying the dust bin 200 is ended, the station control unit 400 may rotate the fixing part motor 133 in the reverse direction to release the fixing of the first cleaner 200.

When the station control unit 400 determines that the first cleaner 200 is fixed to the coupling part 120, the station control unit 400 may operate the door motor 142 to open the door 141 of the cleaner station 100.

When the door 141 or the door arm 143 reaches a predetermined opened position, the door opening/closing detecting part 144 may transmit a signal indicating that the door 141 is opened. The station control unit 400 may receive the signal, which indicates that the door 141 is opened, from the door opening/closing detecting part 137 and determine that the door 141 is opened. When the station control unit 400 determines that the door 141 is opened, the station control unit 400 may stop the operation of the door motor 142.

Meanwhile, when the operation of emptying the dust bin 200 is ended, the station control unit 400 may rotate the door motor 142 in the reverse direction to close the door 141.

When the station control unit 400 determines that the door 141 is opened, the station control unit 400 may operate the cover opening motor 152 to open the discharge cover 222 of the first cleaner 200.

When a guide frame 151*e* reaches a predetermined opened position, the cover opening detecting part 155*f* may transmit a signal indicating that the discharge cover 222 is opened. The station control unit 400 may receive the signal, which indicates that the discharge cover 222 is opened, from the cover opening detecting part 155*f* and determine that the discharge cover 222 is opened. When the station control unit 400 determines that the discharge cover 222 is opened, the station control unit 400 may stop the operation of the cover opening motor 152.

The station control unit 400 may control the sterilization module 175. For example, the station control unit 400 operates the sterilization module 175 after dust is captured in the dust collecting part 170 or at predetermined time intervals to sterilize viruses or microorganisms existing inside or outside the dust collecting part 170.

The station control unit 400 may control the flow path switching valve 183 of the flow path part 180. For example, the station control unit 400 may selectively open or close the first suction flow path 181 and the second suction flow path 182.

The station control unit 400 may operate the dust collecting motor 191 to suck dust (de) (refer to FIGS. 16 and 17) inside the dust bin 200. In addition, when the operation of the dust collecting motor 191 is finished, the station control unit 400 may adjust an opening angle of the door 141 to a predetermined angle before operating the suction motor 214 of the first cleaner 200 to suck residual foreign substances such as strands of hair. More specifically, after the operation of the dust collecting motor 191 is finished, in a state in which the door 141 is still opened, the station control unit 400 may control the door motor 141 in the reverse direction so as to move the door 141 in a direction of closing the dust passage hole 121*a*. The station control unit 400 may stop controlling the door motor 141 when the door is opened at a predetermined angle. After the opening angle of the door 141 is adjusted, the first cleaner 200 may operate the suction motor 214. That is, the door opening angle during the operation of the suction motor 200 is smaller than the door opening angle during the operation of the dust collecting motor 191. The door opening angle here may mean an angle formed between a position at which the door 141 blocks the dust passage hole 121*a* and a position at which the door 141 rotates about the hinge part 141*b* and is opened.

The station control unit 400 may operate the display unit 410 so as to display the dust bin emptying state and the charging state of the first cleaner 200 (or the second cleaner 300).

Meanwhile, the cleaner station 100 according to the present disclosure may include the display unit 410.

The display unit 410 may be disposed on the housing 110, disposed on a separate display device, or disposed on a terminal such as a mobile phone.

The display unit 410 may be configured to include at least any one of a display panel capable of outputting texts and/or figures and a speaker capable of outputting voice signals and sound. The user may easily ascertain a situation of a currently performed process, a residual time, and the like on the basis of information outputted through the display unit 410.

Meanwhile, the cleaner station 100 according to an embodiment of the present disclosure may include a memory 430. The memory 430 may include various data for driving and operating the cleaner station 100.

Meanwhile, the cleaner station 100 according to the embodiment of the present disclosure may include an input unit 440. The input unit 440 generates key input data input by the user to control the operation of the cleaner station 100. To this end, the input unit 440 may include a key pad, a dome switch, and a touch pad (static pressure/capacitance). In particular, when the touch pad and the display unit 410 form a mutual layer structure, this may be referred to as a touch screen.

Figure 12:
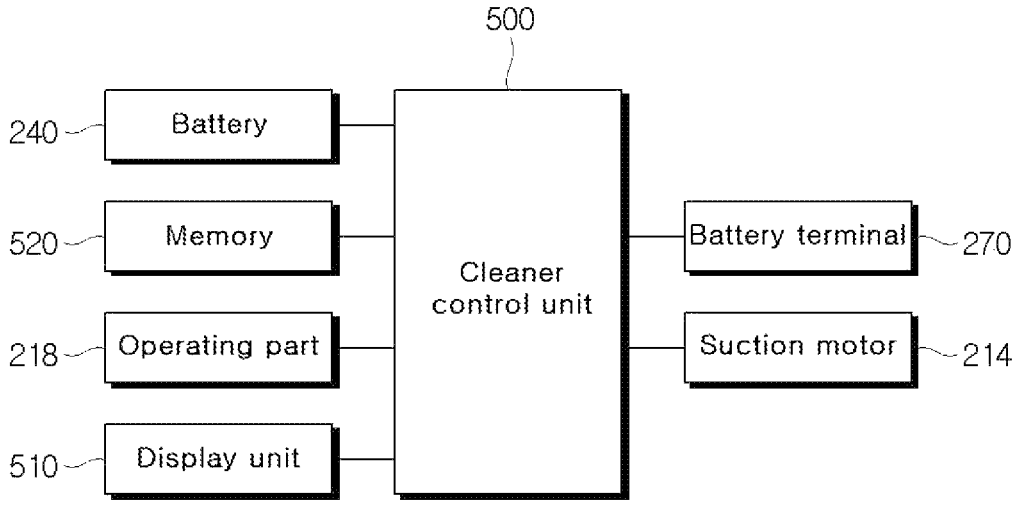
FIG. 12 is a block diagram of a cleaner included in a cleaner system according to an embodiment of the present disclosure.

FIG. 12 is a block diagram of the cleaner included in the cleaner system according to an embodiment of the present disclosure.

With reference to FIG. 12, a control configuration of the first cleaner 200 of the present disclosure will be described as below.

The first cleaner 200 may further include a cleaner control unit 500 configured to control drive of the suction motor 214.

The cleaner control unit 500 may be configured with a printed circuit board, and elements mounted on the printed circuit board.

When the cleaner control unit 500 receives an input for performing a cleaning operation from the operating part 218, the cleaner control unit 500 may control the suction motor 214 to drive. The cleaner control unit 500 may control an operation intensity of the suction motor 214 depending on kinds of commands input from the operating part 218. For example, the command may be a start command for starting the drive of the suction motor 214. Alternatively, for example, the command may be a command for improving the suction force provided to the cleaning module 260. Alternatively, for example, the command may be a command for decreasing the suction force provided to the cleaning module 260. The operating part 218 may be configured with a plurality of buttons for receiving commands input distinctively.

The cleaner control unit 500 may drive the suction motor 214 in a state in which the first cleaner 200 is coupled to the cleaner station 100. More specifically, when the first cleaner 200 receives a pulse signal through the battery terminal 270 coupled to the charging terminal 218 of the cleaner station 100, the cleaner control unit 500 may drive the suction motor 214 after a predetermined waiting time elapses since when the pulse signal is received. The predetermined waiting time may be set to be a proper time so that the suction motor 214 can start the drive after the dust collecting motor 191 of the cleaner station 100 finishes the operation.

At this time, the cleaner control unit 500 may drive the suction motor 214 in a state in which the door 141 of the cleaner station 100 is opened at a predetermined angle. Through this configuration, foreign substances (refer to FIGS. 16 and 17) such as strands of hair (ha) which are hung in a lower end of the dust bin 220 and which have not yet been collected may be sucked into the dust bin 200.

Meanwhile, the foreign substances (refer to FIGS. 16 and 17) such as strands of hair (ha) must move a shorter distance to be captured into the inside of the cleaner station 100 than a distance to be sucked into the dust bin 220 of the first cleaner again. That is, compared to sucking residual foreign substances into the inside of the cleaner station 100 by driving the dust collecting motor 191, sucking the residual foreign substances into the dust bin 220 of the cleaner again by driving the suction motor 214 consumes less power for a shorter period of time. As a result, according to the present disclosure, it is advantageous to remove the residual foreign substances while minimizing energy consumed in the removal.

In addition, when the cleaner system 10 is driven, the dust collecting motor 191 (and the suction motor 214) is driven as well, and noise is generated. At this time, as described above, a less period of time is taken in sucking the residual foreign substances according to the present disclosure, therefore, the overall time of driving the cleaner system 10 is reduced. Therefore, it is advantageous to reduce time for which the user is exposed to the noise of the cleaner operation.

In addition, by sucking the residual foreign substances which are difficult to remove by merely applying the suction force, that is, those to be manually removed by the user again into the dust bin 220 and storing therein, the convenience of allowing the user to directly manage later may be provided. The residual foreign substances which are difficult to remove by merely applying the suction force may be, for example, a case in which strands of hair are firmly stuck to the mesh net, or a case in which dust of a large size (such as cookie crumbs etc.) are stuck in the suction port.

The first cleaner 200 may further include the display unit 510. The display unit 510 may be configured to include a display panel capable of outputting texts and/or figures and may be disposed in the main body of the first cleaner 200. For example, the display unit 510 may be disposed together with the operating part 218, and may be disposed on an upper surface of the first extension 216*b* of the handle 216.

The cleaner control unit 500 may control the display unit 510 such that the charging state of the first cleaner 200 can be displayed therein.

The first cleaner 200 may further included a memory 520. The memory 520 may include various data for driving and operating the first cleaner 200. The memory 520 may store a program including a logic to determine whether the charging holder to which the first cleaner 200 is coupled is the cleaner station 100 capable of capturing dust of the dust bin 220, or a general charging holder having no feature of capturing dust.

When the first cleaner 200 receives the pulse signal provided by the cleaner station 100, the cleaner control unit 500 may use the logic of the program stored in the memory 520 so as to determine whether the charging holder to which the first cleaner 200 is coupled is the cleaner station 100 having a feature of capturing dust or not. To this end, the cleaner control unit 500 may periodically measure a voltage input through the battery terminal 270.

For example, the cleaner control unit 500 may determine that the first cleaner 200 is coupled to the cleaner station 100, when the cleaner control unit 500 determines that the charging voltage applied to the battery terminal 270 is the pulse signal repeating the turning on or off.

For example, the cleaner control unit 500 may determine that the first cleaner 200 is coupled to the general charging holder when the cleaner control unit 500 determines that the charging voltage applied to the battery terminal 270 is the DC signal maintaining turning on for a certain period of time or more.

Referring to FIG. 11 again, the first cleaner 200 may include a switching element M2 connected to the battery 240, and the switching element M2 may be in a turn-off state. The cleaner control unit 500 may be connected to a voltage measuring terminal (CHG_vol). When the first cleaner 200 is coupled to the charging holder, of which a kind thereof is not determined, since the switching element M2 is in the turn-off state, the voltage of the pulse signal input through the battery terminal 270 may be introduced into the voltage measuring terminal (CHG_vol) and may be measured. The voltage which is measured with respect to the introduced pulse signal may be measured with a magnitude dropped in a certain ratio compared to the voltage of the pulse signal depending on a magnitude of a resistance connected to the voltage measuring terminal (CHG_vol).

The cleaner control unit 500 may measure a voltage detected in the voltage measuring terminal (CHG_vol) periodically, and may determine whether the first cleaner 200 is coupled to the cleaner station 100 or a general charging holder. For example, in an embodiment in which the pulse signal provided by the cleaner station 100 is applied three times which is the predetermined number of times at 50 ms interval which is the predetermined interval, the cleaner control unit 500 may monitor the measured voltage at an interval shorter (for example, 10 ms) than the predetermined interval at which the pulse signal is applied.

The cleaner control unit 500 may monitor the voltage the predetermined measurement number of times and may calculate the mean value V1. The cleaner control unit 500 may calculate the mean value V1 the predetermined number of times and may compare the value with a reference voltage value V2. For example, in an embodiment in which the pulse signal is applied from the cleaner station 500 to the first cleaner 200 three times at a 50 ms interval, when the first cleaner 200 measures the voltage at a 10 ms interval, the mean value of the voltages in the initial four times (measured from 10 ms to 40 ms) may be calculated as the first mean value (V1_1), the mean value of the voltages in the following four times (measured from 50 ms to 80 ms) may be calculated as the second mean value (V1_2), and the mean value of the voltages in the last four times (measured from 90 ms to 120 ms) may be calculated as the third mean value (V1_3). At this time, when the first value (V1_1) to the third mean value (V1_3) are all greater than the reference voltage value V2, it may be determined that the first cleaner 200 is coupled to the general charging holder. To the contrary, when any one mean value among the first mean value (V1_1) to the third mean value (V1_3) is less than the reference voltage value V2, it may be determined that the first cleaner 200 is coupled to the cleaner station 100. Such determination is attributable to a fact that the measured voltage becomes 0V at a time point of measurement (in the described example, a time point between 60 ms to 90 ms) by the pulse signal applied when the first cleaner 200 is coupled to the cleaner station 100, and that the mean value V1 of the voltages becomes smaller than the reference voltage value V2.

The cleaner control unit 500 may identify kinds of the charging holder and then, may turn on the switching element M2 so that power can be supplied to the battery 240. At this time, for example, the switching element of the cleaner 200 may be configured with a combination of a transistor Q2 and a mosfet M2, and the cleaner control unit 500 may control turning on or off of the mosfet M2 connected to the battery 240 by controlling turning on or off of the transistor Q2 (Refer to FIG. 11).

Figure 13:
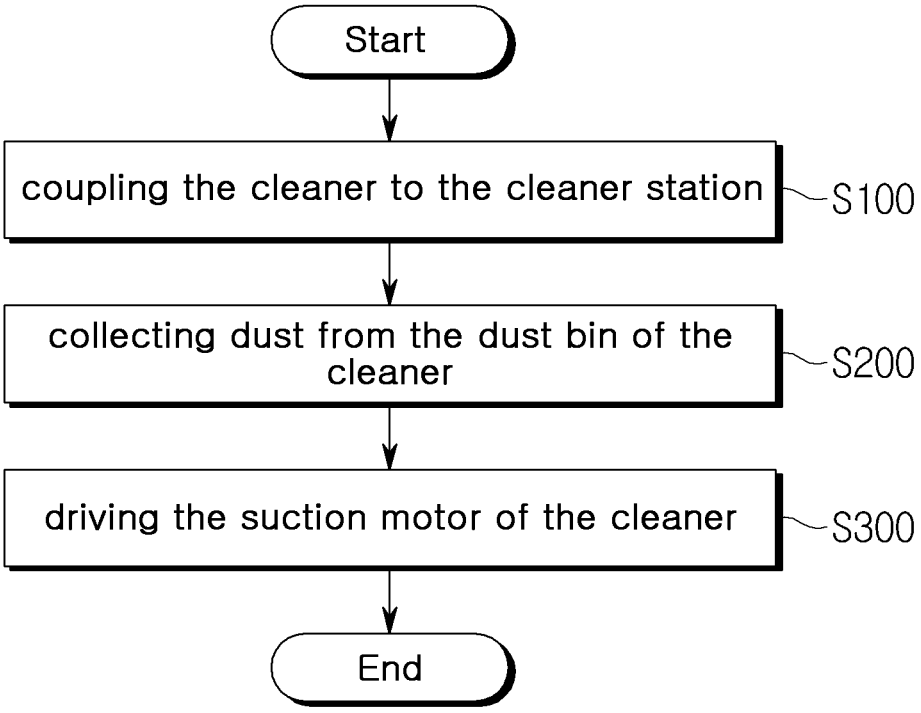
FIG. 13 is a flow chart for describing a method for controlling a cleaner system according to an embodiment of the present disclosure.
Figure 14:
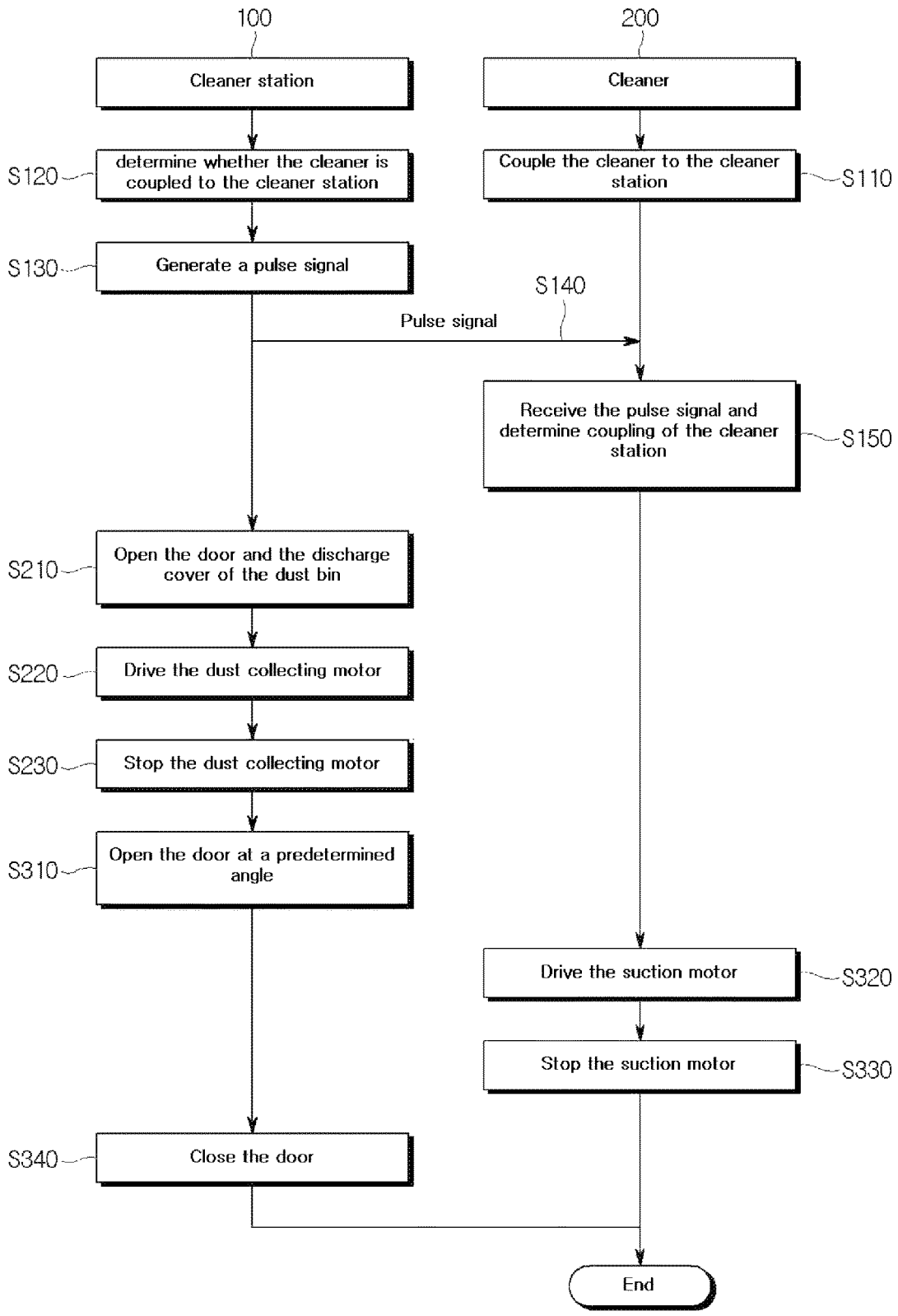
FIG. 14 is a flow chart for describing a method for controlling a cleaner system of FIG. 13, which further includes sub-steps.
Figure 15:
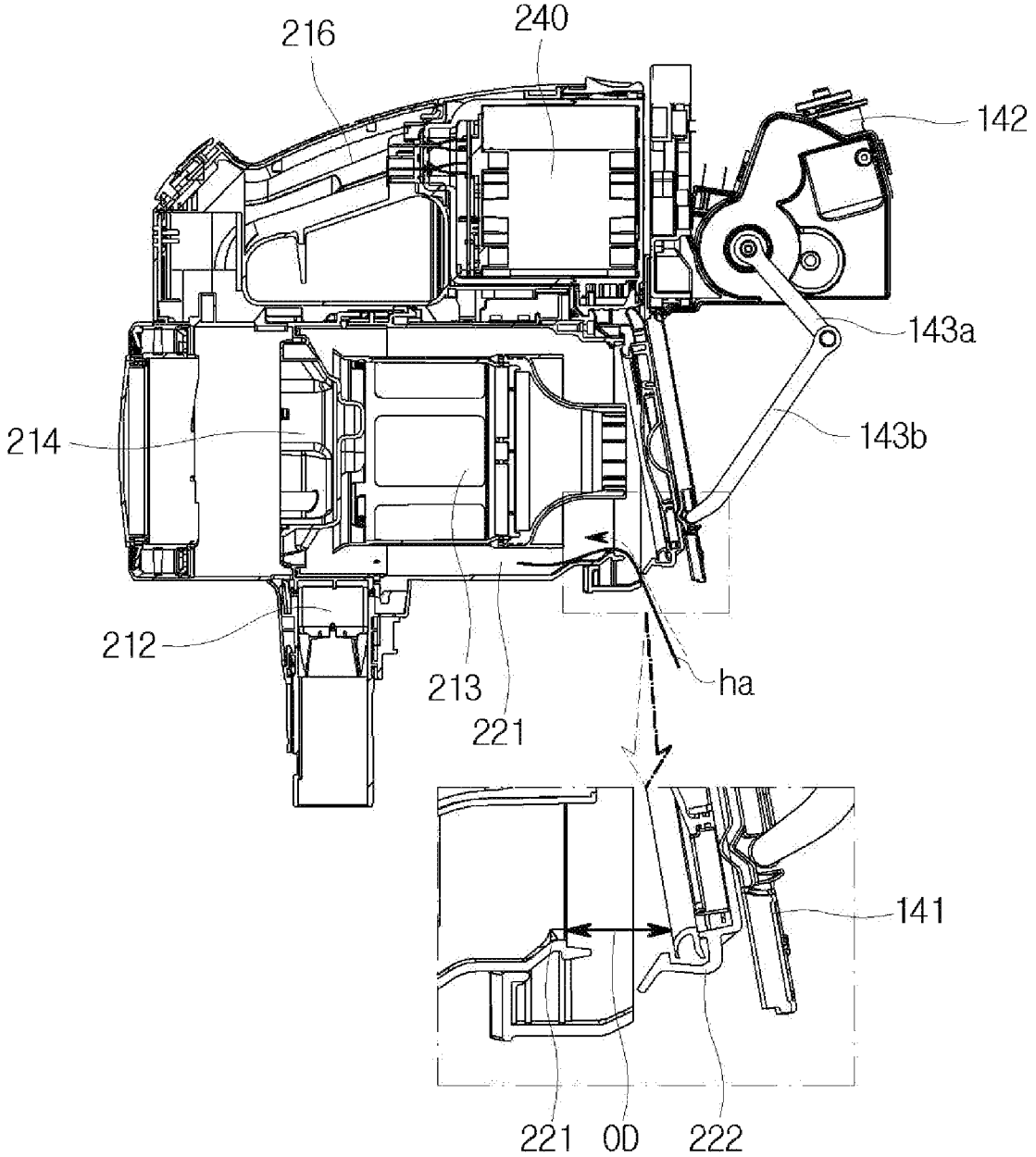
FIG. 15 shows a position relation between a cleaner main body and a door unit in the driving the suction motor of FIG. 13.
Figure 16:
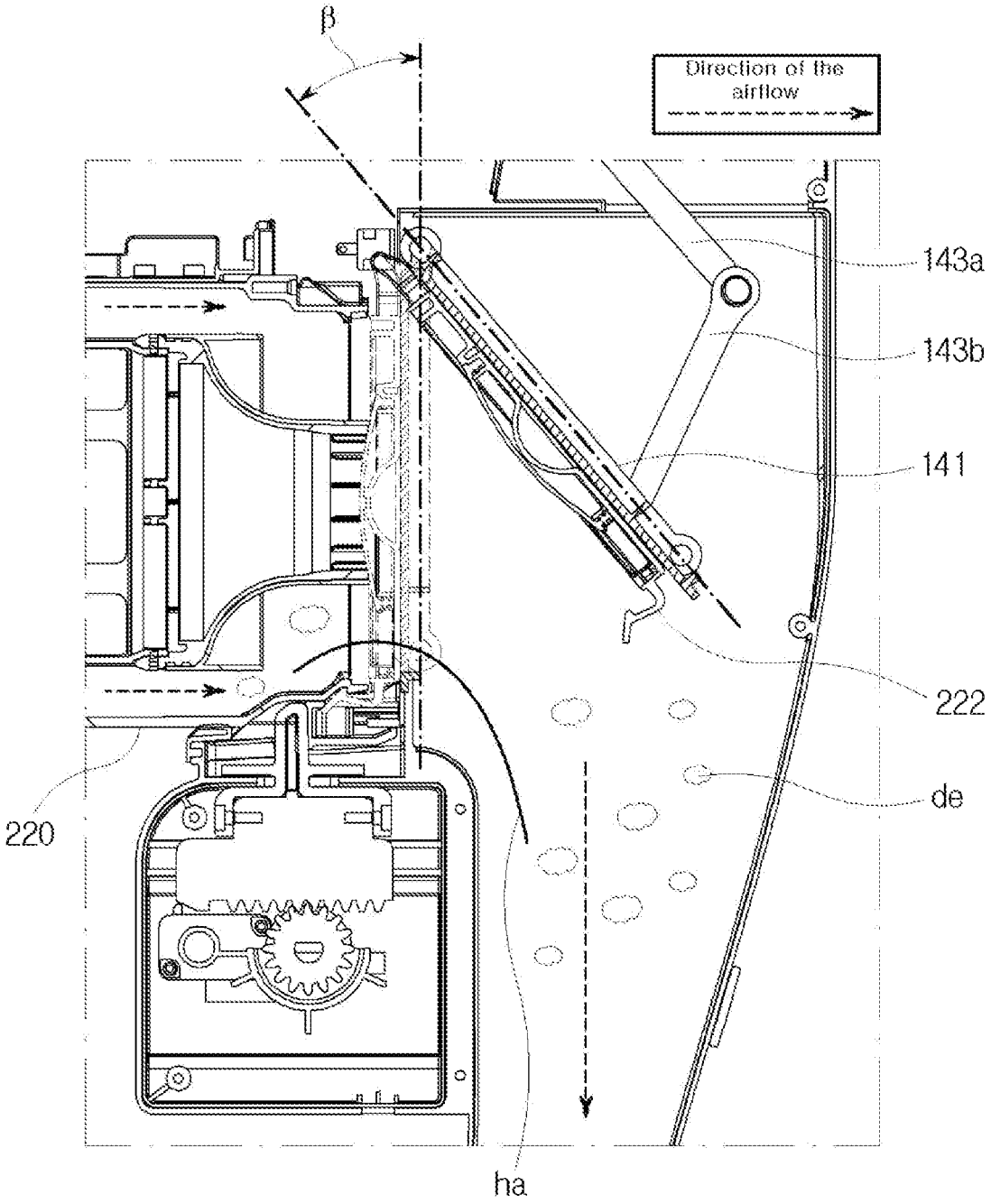
FIG. 16 shows an opening angle of a door when a dust collecting motor is driven.
Figure 17:
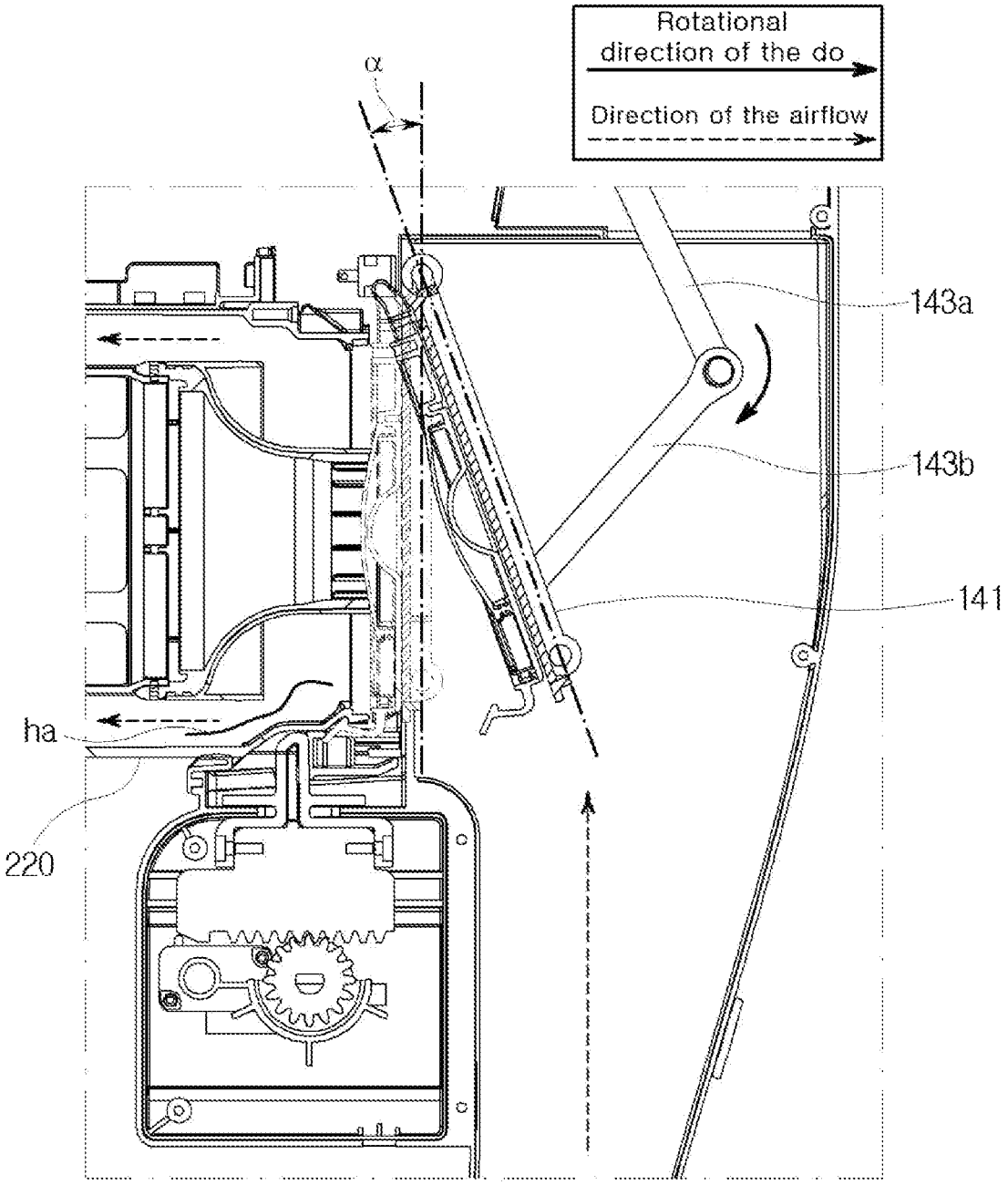
FIG. 17 shows an opening angle of a door when a suction motor is driven.

FIG. 13 is a flow chart for describing the method for controlling the cleaner system according to an embodiment of the present disclosure, FIG. 14 is a flow chart for describing the method for controlling the cleaner system of FIG. 13, which further includes sub-steps, FIG. 15 shows a position relation between the cleaner main body and the door unit in the driving the suction motor of FIG. 13, FIG. 16 shows an opening angle of the door when the dust collecting motor is driven, and FIG. 17 shows an opening angle of the door when the suction motor is driven.

With reference to FIGS. 13 to 17, the method for controlling the cleaner system, which is an embodiment of the present disclosure, may include coupling the cleaner to the cleaner station (S100); allowing the cleaner station to collect dust from the dust bin (S200); and driving the suction motor of the cleaner (S300).

First, the coupling the cleaner to the cleaner station (S100) is a step in which the first cleaner 200 is seated in and coupled to the coupling part 120 of the cleaner station 100, the dust bin 220 of the first cleaner 200 and the battery housing 230 are seated in the coupling part 120 so as to face the coupling surface 121, and the battery terminal 270 of the first cleaner 200 is coupled to the charging terminal 128 of the cleaner station 100 so that both terminals electrically connected to each other.

In this step S100, when the station control unit 400 determines that the first cleaner 200 is coupled thereto (S120), the station control unit 400 generates the pulse signal (S130), and provides the pulse signal to the first cleaner 200 (S140).

More specifically, in the step S100, when the first cleaner 200 is coupled to the coupling part 120, the coupling sensor 125 disposed on the guide protrusion 123 may contact the battery housing 230, and the coupling sensor 125 may provide a signal indicating that the first cleaner 200 is coupled to the coupling part 120. Alternatively, according to an embodiment, the coupling sensor of a non-contact sensor type disposed on the sidewall 124 may detect the presence of the dust bin 220, and the coupling sensor 125 may provide a signal indicating that the first cleaner 200 is coupled to the coupling part 120 to the station control unit 400.

Therefore, in the step S100, the station control unit 400 may receive the signal generated by the coupling sensor 125 and determine that the first cleaner 200 is coupled to the coupling part 120.

Meanwhile, in the step S100, the station control unit 400 may check whether the first cleaner 200 is coupled at an exact position based on whether the charging terminal 128 supplies power through the battery terminal 270 of the first cleaner 200.

In other words, in the step S100, the station control unit 400 may receive a signal indicating that the first cleaner is coupled through the coupling sensor 125, check whether power is supplied to the first cleaner 200 through the charging terminal 128, and then determine that the first cleaner 200 is coupled to the coupling part 120 of the cleaner station 100.

Meanwhile, the pulse signal that the station control unit 400 provides to the first cleaner 200 is a signal which is generated by turning on or off the application of the charging voltage for charging the first cleaner 200 at a predetermined interval a predetermined number of times, and the pulse signal may be provided to the first cleaner 200 through the battery terminal 270 of the first cleaner 200.

For example, the predetermined interval of the pulse signal may be 50 ms, and the predetermined number of times may be three times. That is, the station control unit 400 may control the application of the charging voltage in the order of turning on, turning off, turning on, turning off, and turning on the application so as to generate the pulse signal.

Meanwhile, in this step S100, when the first cleaner 200 is coupled to the cleaner station 100 (S110), the first cleaner 200 may receive the pulse signal from the cleaner station 100, and determine whether the component to which the first cleaner 200 is coupled is the cleaner station 100 having a feature of capturing dust of the dust bin 220, or a general charging holder having merely a charging feature (S150).

More specifically, when the cleaner control unit 500 receives the pulse signal and determines that the first cleaner 200 is coupled to the cleaner station 100, the cleaner control unit 500 may count a waiting time for driving the suction motor 214. The predetermined waiting time may have been set in the memory 520 of the first cleaner 200. The predetermined waiting time may be set to be a proper time so that the suction motor 214 can start the drive after the dust collecting motor 191 of the cleaner station 100 finishes the drive.

As such, transmission of the pulse signal by using the power line for supplying power between the cleaner station 100 and the first cleaner 200 may be referred to as the power line communication. Using the power line communication, the first cleaner 200 may easily recognize kinds of the charging holder to which the first cleaner 200 is coupled, even though there is no additional communication module for providing control commands between the cleaner station 100 and the first cleaner 200. The first cleaner 200 may determine whether to perform the next operation for sucking again the residual dust into the dust bin 220 of the first cleaner 200, after figuring out kinds of the charging holder.

Meanwhile, while the waiting time is counted, the following step S200 of allowing the cleaner station to collect dust from the dust bin of the first cleaner is performed (S200).

When the station control unit 400 determines that the first cleaner 200 is coupled, the station control unit 400 may control the fixing unit 130, the door unit 140, the cover opening unit 150, and the dust collecting motor 191 so as to collect the dust accumulated inside the dust bin 220 of the first cleaner 200 into the dust collecting part 170, in the step S200.

More specifically, the step S200 may include a step S210 of opening the door and the discharge cover of the dust bin.

The step S210 of opening the door and the discharge cover of the dust bin is a step for opening the door 141 of the cleaner station 100 so as to open the dust passage hole 121*a*, and opening the discharge cover 222 of the first cleaner 200 so as to allow communication between the first suction flow path 181 (hereinafter, referred to as the 'suction flow path 181') and the inside of the dust bin 220.

Meanwhile, in the step S210, fixing the dust bin 220 to prevent the dust bin 220 from swaying may be further performed before opening the door 141 and the discharge cover 222. This step may be performed by allowing the fixing member 131 to hold and fix the dust bin 220.

More specifically, when the station control unit 400 receives a signal indicating that the first cleaner 200 is coupled from the coupling sensor 125, the station control unit 400 may operate the fixing part motor 133 in the forward direction so as to fix the dust bin 220. At this time, when the fixing member 131 or the fixing part link 135 is moved to a position for fixing the dust bin, the fixing detecting part 137 may provide a signal indicating that the first cleaner 200 is fixed. Therefore, the station control unit 400 may determine that the first cleaner 200 is fixed by receiving the signal indicating that the first cleaner 200 is fixed from the fixing detecting part 137. When the station control unit 400 determines that the first cleaner 200 is fixed, the station control unit 400 may stop the operation of the fixing part motor 133.

Unlike the above, the station control unit 400 may stop the operation of the fixing part motor 133 after operating the fixing part motor 133 in the forward direction for a predetermined fixing period of time. For example, the station control unit 400 may operate the fixing part motor 133 in the forward direction for 4 seconds or more and 5 seconds or less, and then may stop the operation of the fixing part motor 133.

Meanwhile, in the step S210 of opening the door and the discharge cover of the dust bin, the discharge cover 222 of the first cleaner 200 may be opened by the cover opening unit 150.

More specifically, when the station control unit 400 receives a signal indicating that the dust bin 220 is fixed from the fixing detecting part 137, the station control unit 400 may operate the cover opening motor 152 in the forward direction to open the discharge cover 222 of the first cleaner 200.

When the station control unit 400 operates the cover opening motor 152 in the forward direction, the push protrusion 151 may be moved to a position of pressing the coupling lever 222*c*, leaving from the original position. Therefore, by the movement of the coupling lever 222*c*, the hook engagement between the discharge cover 222 and the dust bin main body 221 may be released, and by the restoration force of the torsion spring 222*d*, the discharge cover 222 may be rotated in a direction away from the dust bin main body 221 to be separated from the dust bin main body 221.

Meanwhile, before the push protrusion 151 presses the coupling lever 222*c*, the opening detecting part 155*f* may provide a signal indicating that the push protrusion 151 is in the original position.

When the cover opening motor 152 is operated and starts moving so as to press the coupling lever 222*c*, the cover opening detecting part 155*f* may provide a signal indicating that the push protrusion 151 left the original position. In addition, the station control unit 400 may receive the signal and determine that the cover opening unit 150 is normally operated.

At this time, using a timer (not illustrated), the station control unit 400 may measure a time after operating the cover opening motor 152 in the forward direction, or measure a time after the push protrusion 151 leaves the original position.

At this time, a time taken for the push protrusion 151 to start leaving the original position until pressing the coupling lever 222*c* on the basis of the rotation speed of the cover opening motor 152 and the movement distance of the push protrusion 151 may be predetermined and stored in the memory 430. Therefore, the station control unit 400 may operate the cover opening motor 152 in the forward direction during the cover opening time which is equal to or more than the above-mentioned time taken until pressing the coupling lever 222*c*. For example, the station control unit 400 may operate the cover opening motor 152 in the forward direction for 4 seconds or more and 5 seconds or less.

In addition, the station control unit 400 may switch a rotational direction of the cover opening motor 152 during a predetermined time of switching the rotational direction after the cover opening time elapses.

Further, the station control unit 400 may operate the cover opening motor 152 in the reverse direction after the time of switching the rotational direction elapses. As a result, the push protrusion 151 may return to the original position.

The station control unit 400 may operate the cover opening motor 152 until the cover opening detecting part 155*f* detects the return of the push protrusion 151 to the original position. At this time, in the memory 430, the time of the push protrusion return until the push protrusion returns to the original position after pressing the coupling lever 222*c* may be predetermined and stored. Therefore, the station control unit 400 may drive the cover opening motor 152 in the reverse direction during the time of the push protrusion return. For example, the station control unit 400 may drive the cover opening motor 152 in the reverse direction for 4 seconds or more and 5 seconds or less.

Meanwhile, the station control unit 400 may stop the drive of the cover opening motor 152, when receiving a signal indicating that the push protrusion 151 has returned to the original position from the cover opening detecting part 155*f*.

Meanwhile, in the step S210 of opening the door and the discharge cover of the dust bin, the station control unit 400 may open the door 141 at the same time of opening the discharge cover 222.

More specifically, the station control unit 400 may open the door 141 when the dust bin 220 is fixed to the cleaner station 100. When the station control unit 400 receives the signal indicating that the dust bin 220 is fixed from the fixing detecting part 137, the station control unit 400 may operate the door motor 142 in the forward direction so as to allow the door 141 to rotate so that the dust passage hole 121*a* can be opened. That is, the station control unit 400 may open the dust passage hole 121*a* by rotating the door 141 in the step of opening the door (S30).

Meanwhile, in the present embodiment, after receiving the signal indicating that the dust bin 220 is fixed from the fixing detecting part 137, the station control unit 400 may operate the door motor 142 in the forward direction after a predetermined time elapses. For example, the station control unit 400 may operate the door motor 142 after a predetermined time of 0.5 second or more and 1.5 second or less elapses.

With this configuration, after lapse of a waiting time required for the push protrusion 151 to start pressing the coupling lever 222*c*, the door 141 may be opened, and the discharge cover 222 and the door 141 may be opened at a similar time point. Therefore, in a state in which the door 141 rotates first and the dust passage hole 121*a* is opened, it is possible to prevent cases in which the door 141 and the discharge cover 222 collide with each other strongly as the discharge cover 222 is suddenly opened by the restoration force of the torsion spring 222*d*, or which the discharge cover 222 is not separated from the dust bin main body 221 since the door 141 is not opened even though the hook engagement between the discharge cover 222 and the dust bin main body 221 is released.

Meanwhile, the station control unit 400 may rotate the door 141 in divided stages and open the dust passage hole 121*a*.

As a result, when the discharge cover 222 and the door 141 are opened, as the discharge cover 222 of the dust bin 220 rotates, the internal space of the dust bin main body 221 is opened, the dust passage hole 121*a* is opened as the door 141 rotates, thereby the suction flow path 181 of the cleaner station 100 and the internal space of the dust bin 220 may be communicated with each other.

Meanwhile, when the door arm 143 moves to the predetermined door opening position, the door opening/closing detecting parts 144 may detect the movement to the position and may provide a signal indicating such a movement to the position. Therefore, the station control unit 400 may determine that the door 141 is opened, and may stop the operation of the door motor 142.

Alternatively, the station control unit 400 may detect that the door 141 is rotated sufficiently, through a value of a current applied to the door motor 142 and the like, determine that the door 141 is opened based on the detection, and stop the operation of the door motor 142.

When the suction flow path 181 and the internal space of the dust bin 220 are communicated with each other as the discharge cover 222 and the door 141 are opened, a step S220 of driving the dust collecting motor proceeds. In the step S220, the dust collecting motor 200 of the cleaner station 100 is driven for a predetermined time of dust collection so as to collect dust of the dust bin 220 into the cleaner station 100.

More specifically, the station control unit 400 may operate the dust collecting motor 191 when a predetermined waiting time of dust collection elapses.

For example, the station control unit 400 may start operating the dust collecting motor 191 after a time of 6 seconds or more and 7 seconds or less elapses since when the dust bin is fixed. At this time, the station control unit 400 may gradually increase the rotational speed of the dust collecting motor 191 to a predetermined speed of dust collection for a predetermined time of increasing suction. For example, the station control unit 400 may gradually increase the rotational speed of the dust collecting motor 191 to the predetermined speed of dust collection for a time of 3 seconds or more and 5 seconds or less. This configuration is advantageous in protecting the dust collecting motor 191, and increasing the lifespan of the dust collecting motor 191.

As another example, the station control unit 400 may start operating the dust collecting motor 191 when a time of 10 seconds or more and 11 seconds or less elapses since when the dust bin is fixed. At this time, the station control unit 400 may increase the suction force by increasing the rotational speed of the dust collecting motor 191 to the predetermined speed of dust collection. This configuration is advantageous for minimizing the operation time of the dust collecting motor 191 and thus, improving the energy efficiency, and minimizing noise generation.

Meanwhile, in the step S220 of driving the dust collecting motor, the station control unit 400 may operate the dust collecting motor 191 to rotate at the speed of dust collection for the predetermined time of dust collection. For example, the station collection unit 400 may operate the dust collecting motor 191 at the speed of dust collection for a time of 14 seconds or more and 16 seconds or less, but is not limited thereto, and the time of dust collection may vary depending on the amount of dust stored in the dust bin 220 and the output of the dust collecting motor 191.

The station control unit 400 may stop the dust collecting motor 191 after the predetermined time of dust collection elapses since when the dust collecting motor 191 starts operation (S230).

Next, a step S300 of operating the suction motor of the cleaner is performed. The step S300 is performed after the suction motor 101 is stopped, that is, the step S300 is performed in a state in which the suction motor 101 is stopped and the door 141 is not closed.

Before the suction motor 214 of the first cleaner 200 starts operation, first, the station control unit 400 may open the door 141 at a predetermined angle (S310). More specifically, with reference to FIGS. 15 to 17, the station control unit 400 may control the door motor 142 and move the door 141 in a closing direction. That is, in a state in which the door 141 is fully opened after the operation of the dust collecting motor 191 is stopped, the station control unit 400 may control the door motor 142 to rotate in the reverse direction so that the door 141 can move in a direction of closing the dust passage hole 121*a*.

The station control unit 400 may control the door motor 142 in the reverse direction until the door 141 gets to a state of being opened at a predetermined angle so that the door 141 can move. At this time, the angle (hereinafter referred to as 'a first opening angle (α)') may be predetermined to have a size smaller than the opening angle of the door 141 in the step S220 of operating the dust collecting motor (hereinafter referred to as 'a second opening angle (β)'). (Refer to FIGS. 16 and 17) Each of the first opening angle (α) and the second opening angle (β) may be predetermined and stored in the memory 430 of the cleaner station 100.

The cleaner control unit 500 may operate the suction motor 214 in a state in which the door 141 is opened at the first opening angle (α). (S320) As described above, the operation of the suction motor 214 is performed by the cleaner control unit 500 after the predetermined waiting time elapses since when the first cleaner 200 receives the pulse signal from the cleaner station 100, and the waiting time may be properly set such that the suction motor 214 starts the operation after the operation of the dust collecting motor 191 is stopped and the adjustment of the door 141 to be opened at the first opening angle (α) is performed.

Meanwhile, because the first opening angle (α) is adjusted to have a smaller size than that of the second opening angle (β), it is advantageous for providing a stronger suction force to an opened portion between the discharge cover 222 and the dust bin main body 221 when the dust collecting motor 214 is operated. Preferably, the first opening angle (α) may be set such that an opened distance (OD) between the discharge cover 222 and the dust bin main body 221 becomes 1 mm to 10 mm. Here, the opened distance between the discharge cover 222 and the dust bin main body 221 may mean a horizontal distance from the lowermost end of the coupling surface on which the dust bin main body 221 is coupled to the discharge cover 222 to the discharge cover 222 (Refer to FIG. 15). More specifically, the opened distance may mean a horizontal distance from the farthermost point from the dust bin hinge part 222*b* among a plurality of points of the coupling surface to the discharge cover 222. When the opened distance is smaller than 1 mm, the discharge cover 222 is swayed along with the flow of air due to the sucking operation of the suction motor 214, and blocks the dust passage hole 121*a*, thereby blocking the sucking operation. When the opened distance is greater than 10 mm, the effect of increasing the suction force for sucking the foreign substances such as strands of hair may not be greater than expected.

In addition, the first angle (α) and the second angle (β) may mean angles formed between a position at which the door blocks the dust passage hole 121*a* and a position at which the door 141 rotates about the door hinge part 141*b* and is opened (Refer to FIGS. 17 and 18).

Meanwhile, as described above, the dust bin 220 of the first cleaner 200 may include the torsion spring 222*d* provided on the rotational axis of the discharge cover 222, and at this time, the torsion spring 222*d* may be configured to apply the elastic force in a direction in which the discharge cover 222 is opened. With this configuration, in the step S300, when the suction motor 214 operates, the discharge cover 222 continues receiving a force (an elastic force or a restoration force) applied in the direction of the door 141 by the torsion spring 222*d*.

Assume a case in which the torsion spring 222*d* is not provided. At this time, due to the influence of the suction force generated by the suction motor 214, the discharge cover 222 blocks the dust bin 220, and therefore, there occurs a problem of becoming difficult to achieve the original object that is sucking foreign substances such as strands of hair.

On contrary, as provided in the present disclosure, when the torsion spring 222*d*, configured to apply the elastic force in the direction in which the discharge cover 222 is opened, is provided, the elastic force is applied in the opposite direction to a direction in which the suction force of the suction motor 214 is applied, and therefore, the problem of which the discharge cover 222 blocks the dust bin 220 may be prevented.

The cleaner control unit 500 may control the suction motor 214 to operate for a predetermined time of suction and then to stop (S330). The predetermined time of suction of the suction motor 214 may be set in the memory 520 of the first cleaner 200. At this time, the object of operating the suction motor 214 is sucking the residual foreign substances, in other words, sucking fine foreign substances such as strands of hair which may hung and stuck at the lower end of the dust bin 220 as they have not been evacuated from the dust bin 220 during the operation of the dust collecting motor 191. Therefore, the time of suction of the suction motor 214 may be set shorter than the time of dust collection of the dust collecting motor 191.

As described above, after the operation of the dust collecting motor 191 is finished, when the suction motor 214 operates, it is advantageous to provide the user with convenience of hygienically managing the dust bin of the cleaner, because the foreign substances hung at the end of the dust bin 220 may be sucked into the dust bin 220 again.

The door 141 may be closed after the suction motor 214 is stopped (S340). More specifically, the station control unit 400 may control the door motor 142 to rotate in the reverse direction. As the door motor 142 rotates in the reverse direction, the door 141 may move in a direction of closing the dust passage hole 121*a* and may fully close the dust passage hole 121*a* at last. As the door 141 is closed, the discharge cover 222 is moved together with the pushing force of the door 141, and is coupled to the dust bin main body 221 and the discharge cover 222 closes the dust bin 220. That is, the closing of the door 141 and the closing of the dust bin 220 may be performed simultaneously, and when the closing of the door 141 and the dust bin 220 is finished, the control related to dust collection by the cleaner station 100 may be finished.

As described above, according to the present disclosure, by driving the suction motor of the cleaner, it is possible to remove foreign substances such as strands of hair etc. which may remain in a state of being stuck in the open end of the dust bin even after collecting dust of the dust bin. Therefore, the convenience of hygienically managing the cleaner may be provided to the user.

In addition, according to the present disclosure, in the removal of residual foreign substances such as strands of hair etc., in a state in which the dust collecting motor is not driven, the residual foreign substances may be sucked again into the dust bin of the cleaner only by driving the suction motor of the cleaner. Therefore, the residual foreign substances may be effectively removed while minimizing the time and power consumed for the removal of the residual foreign substances.

In addition, according to the present disclosure, since the residual foreign substances are removed by operation for a reduced period of time, it is advantageous to decrease the time for which the consumers are exposed to the operational noise.

Further, according to the present disclosure, it is possible to provide the user with convenience of directly managing the foreign substances later because the residual foreign substances which are difficult to remove merely by applying the suction force and requires manual removal by the user are sucked into the dust bin of the cleaner and are stored therein.

Moreover, according to the present disclosure, it is possible for the cleaner to determine kinds of the charging holder to which the cleaner is coupled by means of the pulse signal provided by the cleaner station to the cleaner. Therefore, the cleaner may decide by itself whether to proceed the following operation for sucking the residual In addition, according to the present disclosure, because the communication between the cleaner station and the cleaner is performed through the power line configured to supply the power, providing, and receiving information between the cleaner station and the cleaner is made possible, without requiring an additional communication module.

Meanwhile, in the above-described embodiments, a series of operations for removing the residual foreign substances are described to be performed by the handy stick cleaner. However, in the case of sucking dust of the dust bin of the robot cleaner with the cleaner station coupled to the robot cleaner, the above-described embodiments may be performed in the same manner. That is, after the operation of the dust collecting motor of the cleaner station is finished, when the suction motor accommodated in the robot cleaner is operated, the residual foreign substances which have been hung in the dust bin of the robot cleaner and thus have not been sucked may be sucked into the dust bin of the robot cleaner again.

While the present disclosure has been described with reference to the specific embodiments, the specific embodiments are only for specifically explaining the present disclosure, and the present disclosure is not limited to the specific embodiments. It is apparent that the present disclosure may be modified or altered by those skilled in the art without departing from the technical spirit of the present disclosure.

All the simple modifications or alterations to the present disclosure fall within the scope of the present disclosure, and the specific protection scope of the present disclosure will be defined by the appended claims.

The invention claimed is:

1. A cleaner system, comprising: a cleaner comprising a dust bin and a suction motor configured to generate a suction force so that air containing dust is introduced into the dust bin; and a cleaner station to which the cleaner is coupled, wherein the cleaner station comprises: a coupling part allowing the cleaner to seat therein and to couple thereto; a suction flow path through which dust discharged from the dust bin flows; a housing in which the coupling part is provided and an internal space configured to accommodate the suction flow path is provided; a dust collecting motor disposed below the suction flow path in the internal space and configured to provide a suction force to the dust bin through the suction flow path; and a door disposed in the coupling part and configured to open or close a dust passage hole formed in one end of the suction flow path, wherein the cleaner station is configured to open the door and to drive the dust collecting motor for a predetermined time of dust collection so as to collect dust in the dust bin into an inside of the cleaner station when the cleaner is coupled to the coupling part, and wherein the cleaner is configured to drive the suction motor in a state in which the door is open after the driving of the dust collecting motor is finished; wherein when the cleaner is coupled to the coupling part and a battery terminal of the cleaner is electrically connected to a charging terminal of the cleaner station, the cleaner station is configured to provide a pulse signal to the cleaner through the battery terminal, and wherein the pulse signal is a signal generated by turning on or off application of a charging voltage for charging the cleaner at a predetermined interval a predetermined number of times, wherein upon receiving the pulse signal, the cleaner is configured to drive the suction motor after a predetermined waiting time elapses.

2. The cleaner system of claim 1, wherein in the cleaner station, an opening angle of the door is adjusted to a predetermined angle, before the suction motor is driven after the driving of the dust collecting motor is finished.

3. The cleaner system of claim 2, wherein the predetermined angle is smaller than an angle at which the door is opened during the driving of the dust collecting motor.

4. The cleaner system of claim 1, wherein the dust bin comprises:

a dust bin main body taking a form of a cylinder and provided in a form in which one side in a longitudinal direction is opened;

a discharge cover rotatably coupled to the one open side of the dust bin main body; and a torsion spring disposed on a rotational axis of the discharge cover rotating about the dust bin main body and configured to apply an elastic force in a direction in which the discharge cover is opened.

5. A cleaner system, comprising: a cleaner comprising a dust bin and a suction motor configured to generate a suction force so that air containing dust is introduced into the dust bin; and a cleaner station to which the cleaner is coupled, wherein the cleaner station comprises: a coupling part allowing the cleaner to seat therein and to couple thereto; a suction flow path through which dust discharged from the dust bin flows; a housing in which the coupling part is provided and an internal space configured to accommodate the suction flow path is provided; a dust collecting motor disposed below the suction flow path in the internal space and configured to provide a suction force to the dust bin through the suction flow path; and a charging terminal disposed in the coupling part and configured to connect to a battery terminal of the cleaner to supply a charging voltage for charging a battery of the cleaner, and wherein the cleaner station is configured to provide a pulse signal to the cleaner through the battery terminal when the cleaner is coupled to the coupling part-; wherein upon receiving the pulse signal, the cleaner is configured to drive the suction motor after a predetermined waiting time elapses.

6. The cleaner system of claim 5, wherein the pulse signal is a signal generated by turning on or off application of the charging voltage at a predetermined interval a predetermined number of times.

7. A cleaner, comprising: a dust bin configured to store dust therein; a suction motor configured to generate a suction force so that air containing dust is introduced into the dust bin; a battery connected to the suction motor and configured to supply power; a battery terminal to which a charging voltage for charging the battery is applied; and a cleaner control unit configured to control drive of the suction motor, wherein the cleaner control unit is configured to control whether to drive the suction motor according to kinds of signals applied to the battery terminal, when the battery terminal is coupled to a charging terminal provided outside a cleaner station; wherein the cleaner control unit is configured to drive the suction motor, when a pulse signal is applied to the battery terminal; and wherein the cleaner control unit is configured to drive the suction motor after a predetermined waiting time elapses since when the pulse signal is applied to the battery terminal.

8. The cleaner of claim 7, wherein the pulse signal is a signal generated by turning on and off application of a charging voltage applied to the battery terminal at a predetermined interval a predetermined number of times.

9. The cleaner of claim 7, wherein the cleaner control unit is configured to set the predetermined waiting time so that the suction motor is driven after drive of a dust collecting motor provided in the cleaner station is finished.

* * * * *